US011064746B2

(12) United States Patent
Thompson

(10) Patent No.: US 11,064,746 B2
(45) **Date of Patent: *Jul. 20, 2021**

(54) SYSTEM AND METHOD FOR CONNECTING GARMENTS AND RELATED ARTICLES

(71) Applicant: Jay Thompson, Denver, CO (US)

(72) Inventor: Jay Thompson, Denver, CO (US)

( * ) Notice: Subject to any disclaimer, the term of this patent is extended or adjusted under 35 U.S.C. 154(b) by 161 days.

This patent is subject to a terminal disclaimer.

(21) Appl. No.: 16/188,486

(22) Filed: Nov. 13, 2018

(65) Prior Publication Data

US 2020/0146374 A1 May 14, 2020

Related U.S. Application Data

(63) Continuation-in-part of application No. 14/993,880, filed on Jan. 12, 2016, now Pat. No. 10,165,814.

(60) Provisional application No. 62/636,635, filed on Feb. 28, 2018, provisional application No. 62/118,757, filed on Feb. 20, 2015, provisional application No. 62/102,318, filed on Jan. 12, 2015.

(51) Int. Cl.

| | |
|---|---|
| ***A41D 19/00*** | (2006.01) |
| ***A41D 3/00*** | (2006.01) |
| ***A41D 19/01*** | (2006.01) |
| ***A41D 27/10*** | (2006.01) |

(52) U.S. Cl.

CPC ..... *A41D 19/0041* (2013.01); *A41D 3/00* (2013.01); *A41D 19/01* (2013.01); *A41D 27/10* (2013.01); *A41D 2400/10* (2013.01); *A41D 2600/10* (2013.01)

(58) Field of Classification Search

CPC ..... A41D 13/0005; A41D 13/0568; A41D 13/0556; A41D 13/00; A41D 19/0089; A41D 19/0041; A41F 1/002

USPC ..... 2/162, 69, 161.2, 160, 158

See application file for complete search history.

(56) References Cited

U.S. PATENT DOCUMENTS

| | | | | |
|---|---|---|---|---|
| 2,686,916 A * | 8/1954 | De Grazia | A41D 19/0055 | 2/162 |
| 4,644,698 A * | 2/1987 | Gerdes | F25D 23/082 | 312/296 |
| 7,051,374 B1 * | 5/2006 | Grilliot | A41D 13/0005 | 2/69 |
| 2008/0092280 A1 * | 4/2008 | Johnson | A41D 13/0005 | 2/455 |
| 2013/0326790 A1 * | 12/2013 | Cauwels | A61B 5/02233 | 2/170 |
| 2016/0198782 A1 * | 7/2016 | Thompson | A41D 19/0041 | 2/162 |

* cited by examiner

*Primary Examiner* — Timothy K Trieu

(74) *Attorney, Agent, or Firm* — Talus Law Group LLC

(57) ABSTRACT

A system and method of selectively connecting at least two articles of clothing is provided. First and second articles, which may comprise a glove and jacket sleeve or cuff, have mating geometries and at least one fastener to securely and selectively connect the two articles. In certain embodiments, magnets are provided as fasteners to connect the articles. For example, in certain embodiments, a method and system is provided that comprises features adapted to allow connection of an accessory (e.g. ski glove) to a portion of another article (e.g. jacket).

17 Claims, 19 Drawing Sheets upper portion lower portion

SYSTEM AND METHOD FOR CONNECTING GARMENTS AND RELATED ARTICLES

This U.S. Non-Provisional Patent Application claims the benefit of priority from U.S. Provisional Patent Application Ser. No. 62/102,318, filed Jan. 12, 2015, U.S. Provisional Patent Application Ser. No. 62/118,757, filed Feb. 20, 2015, U.S. Non-Provisional patent application Ser. No. 14/993,880, filed Jan. 12, 2016, and U.S. Provisional Patent Application Ser. No. 62/636,635, filed Feb. 28, 2018, the entire disclosures of which are hereby incorporated by reference in their entireties.

FIELD

Known outwear devices generally comprise jackets with sleeves and cuffs, and gloves or mittens provided as separate components. Advanced devices, including those adapted for use in extreme or hazardous environments contemplate providing a connection or seal between a sleeve of an article and a glove or other hand or foot covering article. In certain devices, a glove member may be formed as a single material with an associated sleeve. It is also known to provide garments with selectively detachable portions, such as leg portions of a pair of pants that are removably attached by way of a zipper or hook and loop closure such that the pants may be selectively converted to a pair of shorts.

The prior art, however, fails to provide devices and systems whereby a first article is selectively attachable to a second article by way of at least one magnet, and wherein the connection is provided such that a preferably thermally insulative seal is reliably and consistently achieved with minimal user input and enhanced user-friendliness.

SUMMARY

Accordingly, there exists a long-felt and unmet need to provide a system for selectively connecting articles of clothing wherein a first article or accessory is connectable to a second article or accessory with minimal effort, and wherein a desired connection and/or seal is reliably and repeatably formed between the articles. There further exists a long-felt and unmet need to provide such a system or systems that is comfortable to wear and use regardless of the situation or activity engaged in by a user or wearer.

In various embodiments, systems and devices of the present disclosure provide a first garment or article and a second garment or article, wherein the first and second garments are selectively connectable to one another with a magnetic connection. In certain embodiments, a system is provided wherein the sleeve or cuff of a first article comprising such features is selectively connectable to a glove or mitten. Such embodiments are contemplated for use in outdoor gear, especially winter and snowsports gear. It will be expressly recognized, however, that the embodiments shown and described herein are not limited to such applications or intended uses. Indeed, devices and systems of the present disclosure are not limited to any particular application or intended use, and reference to such applications or uses are provided by way of example only.

Various embodiments of the present invention contemplate providing an apparel dock system and method. In various embodiments, the apparel dock comprises a system and method for securing an accessory or appendage covering (e.g. glove or glove parts, boot, pants, coat or similar, helmet or hat) to an adjacent appendage covering or to a parking dock on another article. For example, in certain embodiments, a method and system is provided that comprises features adapted to allow connection or docking of an accessory (e.g. ski glove) to a portion of another article (e.g. jacket).

In certain embodiments, an apparel docking systems comprises a first article and a second article, wherein both the first article and the second article each comprise an upper portion and a lower portion. In a preferred embodiment, at least one magnet is provided in the upper portion of the first article that is of opposite polarity and thus attracted to at least one magnet provided in an upper portion of the second article. Additionally, the lower portion of the first article comprises at least one magnet that is of the same polarity and thus opposed to at least one magnet provided in the upper portion of the second article. The first article comprises an upper portion and a lower portion, said upper portion comprising at least one magnet of a first polarity, and said lower portion comprising at least one magnet of a second polarity, said second polarity comprising an opposite polarity of said first polarity. The second article comprises an upper portion and a lower portion, the upper portion comprising at least one magnet of a first polarity, and the lower portion comprising at least one magnet of a second polarity, the second polarity comprising an opposite polarity of the first polarity. In such embodiments, magnet forces will repel the articles when the articles are attempted to be connected in a wrong orientation (e.g. a glove will be repelled from a sleeve or cuff if/when the glove is in an upside-down or otherwise wrong orientation).

Various materials are contemplated for use with embodiments of the present invention. For example, it is contemplated that the systems, engagement devices, and connection members may comprise any one or more of silicon, rubber, synthetic rubber, vinyl, neoprene, textile printed material, and/or materials that could be molded, cast, extruded, or 3D printed. It is contemplated that a compression layer may comprise open cell foam, closed cell foam, gel material, neoprene, or various combinations thereof. A top layer may comprise one or more of rip-stop nylon, vinyl, cotton, fleece, or other synthetic or natural textiles. Embodiments of the present invention contemplate rare earth magnets, ferrous magnets, strip magnets, electromagnets, and various combinations thereof. Magnets may be secured to a material (e.g. riveted) or provided in a layered material. Magnets may also be adhered with adhesive or heat bonded to the exterior of any configuration or embedded (over molded, etc.) in any one or more of the layers.

In addition to or in lieu of magnets, alternative fastener features including hook-and-loop material, buttons, locking interfaces that are comprised of male/female connections, "threaded" connections, etc. to secure the adjacent apparel articles may be provided.

In various embodiments, the orientation of the interface between components or articles comprises an angled interface, such as a pair of mating frustoconical members. In alternative embodiments, an interface between corresponding articles is flat (i.e. 90 degrees to a longitudinal axis of a glove/sleeve combination). In further embodiments, the interface is in plane with an opening.

In various embodiments, the interface is provided as flat, geared with intermeshing "teeth" or other features that allow for male/female-type connection, rounded faces or other notching profiles that accomplish sealing, orientation and insulation, etc. Additionally the interface material could be smooth, patterned or textured.

In a preferred embodiment, an apparel dock system comprises a hand accessory (e.g. glove or mitten) with an engagement device on a second end, and a sleeve with a second end comprising an engagement device proximal to or in lieu of a cuff. In such embodiments, the internal diameter of the engagement device of the hand accessory is greater than an external diameter of the engagement device of the second end of the sleeve, such that the sleeve or cuff member comprises a male feature adapted to be received within the female member of the hand accessory.

In various embodiments, connecting components comprise elastic or partially elastic features, such that the components maintain a desired shape to facilitate connection to each other but also allow for elastic deformation to allow a person's hand or appendage (for example) to pass through the component. In embodiments wherein a connection member comprises an inelastic material (e.g. plastic), such a component is contemplated as being divided into portions and interconnected by at least one elastic member such that otherwise inflexible or inelastic components comprise the ability to elastically expand and accommodate a user's hand or appendage (for example).

In certain embodiments, carbon fiber elements are provided within certain portions of the invention to provide structural integrity. For example, in one embodiment, one or more carbon elements such as a ring of laid-up carbon or a carbon fiber mesh element is provided in a cuff portion of a garment. The carbon element is preferably overmolded with a foam and/or rubber material to conceal the carbon and provide a more comfortable user-interface. Such carbon elements provide structural integrity to a device without significantly increasing the overall weight of the garment or device. Such features may also be provided in glove members, or in both glove and garment (e.g. sleeve/cuff) members. The present invention contemplates the use of carbon in various components and wherever structural integrity and weight are concerned.

In various embodiments, the top layer in a multi-layered embodiment is made of any flexible material including vinyl, ripstop, cotton, plant-based material, fleece, nylon, performance fabrics such as GORE-TEX™. Each of these could be smooth or textured with patterns. Apparel docks and connection members of the present invention are adapted for applications including (not limited to) snow sports, cold weather gear, industrial applications, medical applications, and/or wet applications. Some of the applications for the assembly include glove to jacket or other abdominal covering sleeve interfaces, boot to pant leg, helmet to jacket or other abdominal layer, abdominal covering to lower body covering, sleeve to vest-style covering, mid-leg to lower-leg covering, mid hand to lower hand (finger area).

In various embodiments, the present invention comprises a garment system with embedded features for identifying an individual. Such features include, for example, GPS features and/or RFID cards, chips, tags, and/or similar features to identify an individual using an external device (e.g. a handheld scanner). Such RFID features provide various benefits including, for example, the ability to verify and confirm that an individual is authorized to use a gondola or lift service, track movement(s) of the user (including cardinal movements and elevation changes), and other similar wireless communications without the need to remove a glove or garment.

In certain embodiments, garment systems of the present invention comprise means for communicating with a smart phone or other electronic device. For example, certain embodiments of the present invention contemplate two-way communication capabilities for at least partial operation of a smart phone or tablet device. In one embodiment, the cuff or wrist portion of a jacket and/or glove comprises user-interactive display with two-way communication capabilities with a pre-existing smart phone through known protocol such as BLUETOOTH®. Such embodiments provide the ability to answer calls, send and receive text messages, control music functions, and perform other phone or device-based functions without the need to contact or operate the phone or device directly.

The entire engagement assembly could be 90 degrees to arm orientation or canted at any angle or axis (either engagement surface or entire device). In various embodiments, magnets are oriented at any angle or axis relative to device or engagement surface. The engagement surface could be any shape or angle/axis in terms of engagement. In various embodiments, the engagement device comprises one or more tacky surfaces that seal against each other or in combination with other surfaces/devices—such as over molded side engaging with tacky surface on the opposite side of device.

In various embodiments, the engagement comprises an O-ring on the glove side, such that pulling the glove on would cause the O-ring to push up a gradient surface and would stretch until seating into a channel.

In certain embodiments, it is contemplated that spring loaded buttons are molded into one side with the other side having receiving holes. Magnets, compression fittings, spring loaded components, tacky/grippy/gritty surfaces in any combination could be used to secure and/or seal the intersection/interface or parts thereof.

In various embodiments, magnetic elements are contemplated as being provided in garments that are adapted to be placed in close communication and/or to secure garments and accessories to one another in a preferred state or position of use. Such a connection and position of use includes, for example, the connection of a glove to the cuff of a sleeve in a position wherein the glove and the sleeve are being worn by a user. Additionally, and in various embodiments, the present disclosure contemplates providing a magnet or similar securing device in various positions for securing a garment or accessing when the garment or accessory is not being worn. For example, in certain embodiments, a first garment (e.g. a jacket) comprises a tab or extension comprising a magnetic component. The magnetic component of this tab or extensions comprising a "parking" feature wherein an accessory (e.g. a glove) may be selectively secured to the first garment when the accessory is not being worn. The tab or extension may be provided proximal a waist portion of the first garment, or in any desired location where a user may wish to temporary store or "park" an accessory. In further embodiments, the first garment comprises a magnetic element for parking or storing an accessory, wherein the magnetic element is stitched or otherwise stowed within the garment and the garment is devoid of the aforementioned tab or extension. Such magnetic elements may be provided proximal a chest portion, a waist portion, or any one or more areas where it may be desirable to store an accessory when the accessory is not being worn.

In one embodiment, a system for selectively connecting articles of clothing is provided, the system comprising a first article having a first end and a second end, a second article having a first end and a second end, the second end of said first article comprising at least one magnetic fastener. The first end of the second article comprises at least one magnetic fastener and the first end of the second article comprises a male member adapted to be received within at least a portion of the second end of the first article.

In one embodiment, a system for selectively connecting articles of clothing is provided, the system comprising a first article comprising a glove for surrounding a hand of a user and an access hole. A second article is provided comprising a sleeve member and a cuff. The first article comprises a first connection member provided proximal to the access hole, and the second article comprises a second connection member provided proximal to the cuff. The first connection member and the second connection member are adapted to communicate with one another, and at least one of the connection members is sized to be at least partially received within a portion of the opposing member to selectively connect the first article and the second article. The first connection member comprises at least one magnet, and the second connection member comprises at least one magnet of opposite polarity as the magnet of the first connection member for selectively connecting the first article and the second article.

In another embodiment, a system for selectively connecting articles of clothing is provided, the system comprising a first connection member adapted to be secured to a first article, and a second connection member adapted to be secured to a second article. The first connection member comprises a concave interior surface operable to matingly receive a convex exterior surface of the second connection member and prevent further ingress of the second connection member with respect to the first connection member. The first connection member comprises at least one magnet, and the second connection member comprises at least one magnet of opposite polarity as the magnet of the first connection member for selectively connecting the first article and the second article.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
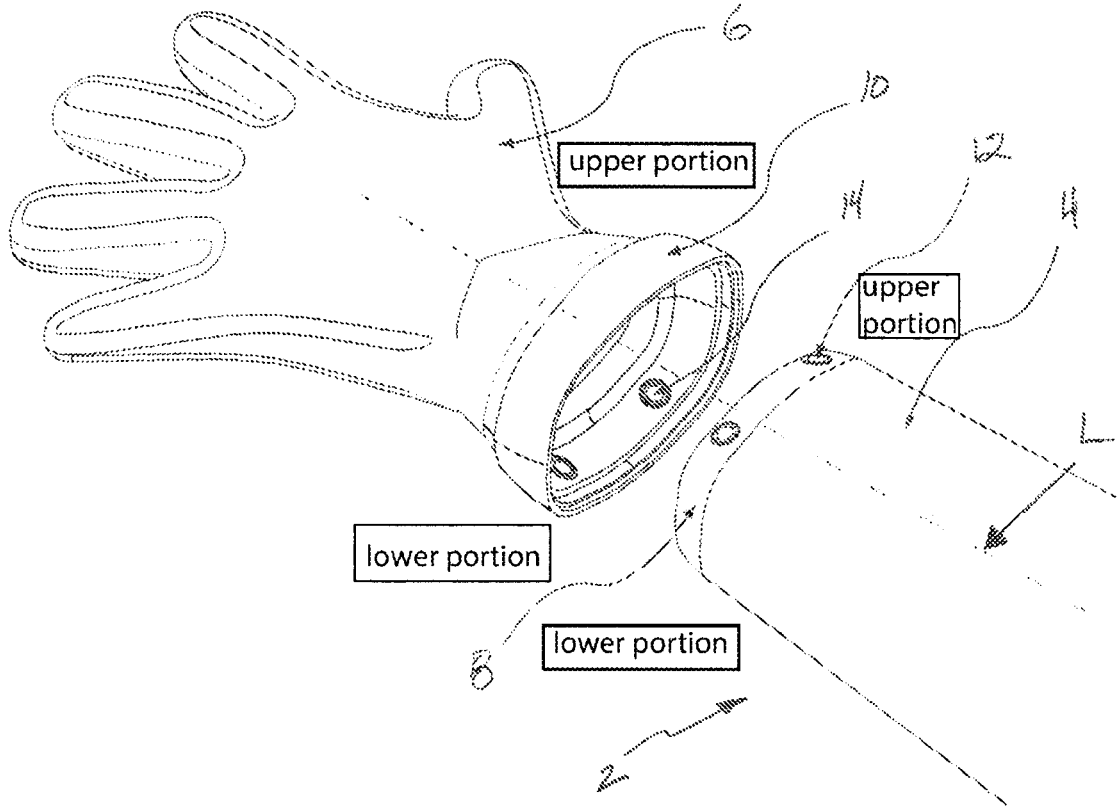

FIG. 1 is a perspective view of a system for selectively connecting articles of clothing according to one embodiment of the present disclosure.

Figure 2:
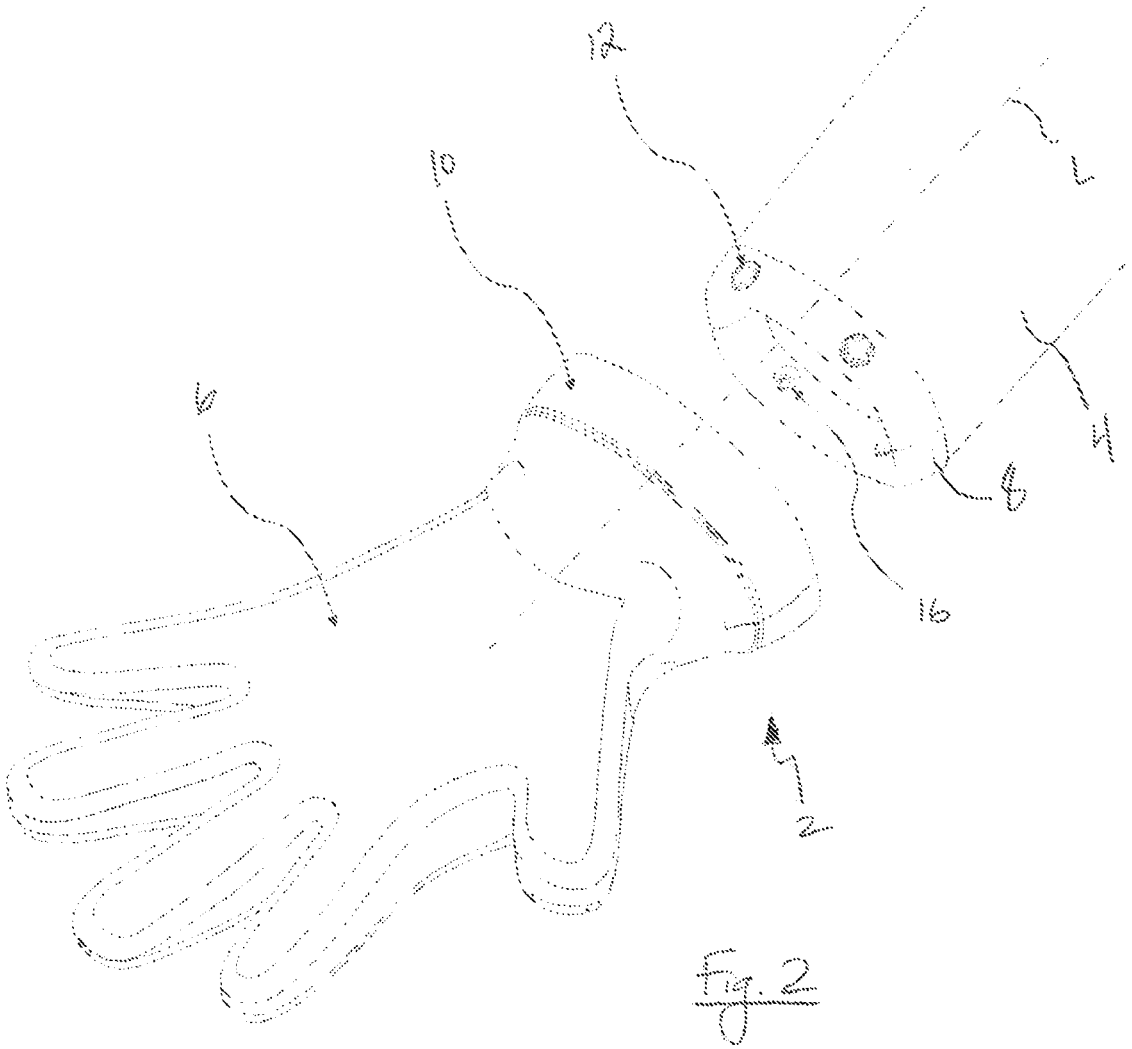

FIG. 2 is a perspective view of a system for selectively connecting articles of clothing according to the embodiment of FIG. 1.

Figure 3:
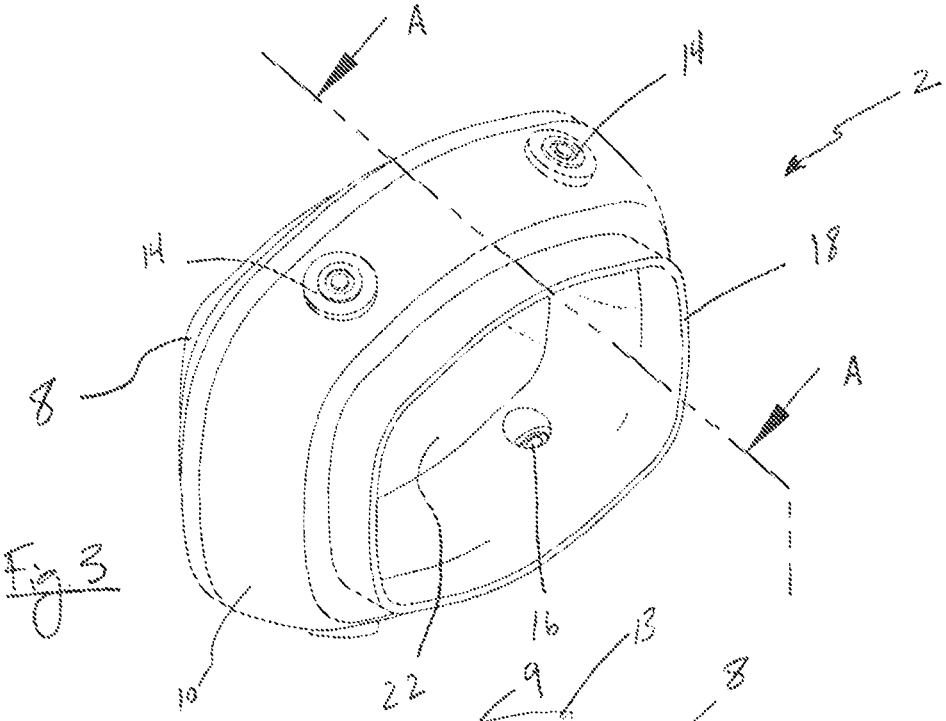

FIG. 3 is a front perspective of a component of a system for selectively connecting articles of clothing according to the embodiment of FIG. 1.

Figure 4:
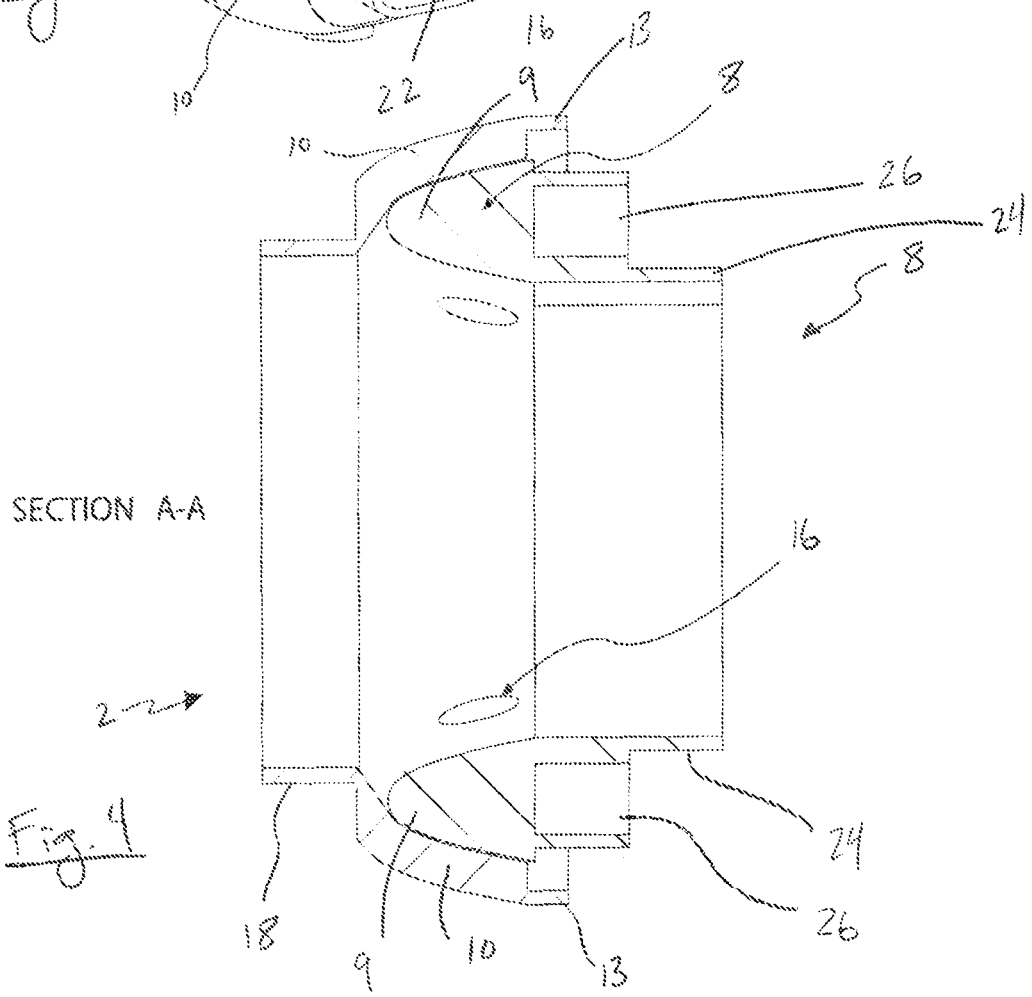

FIG. 4 is a cross-sectional elevation view of the component of FIG. 3.

Figure 5:
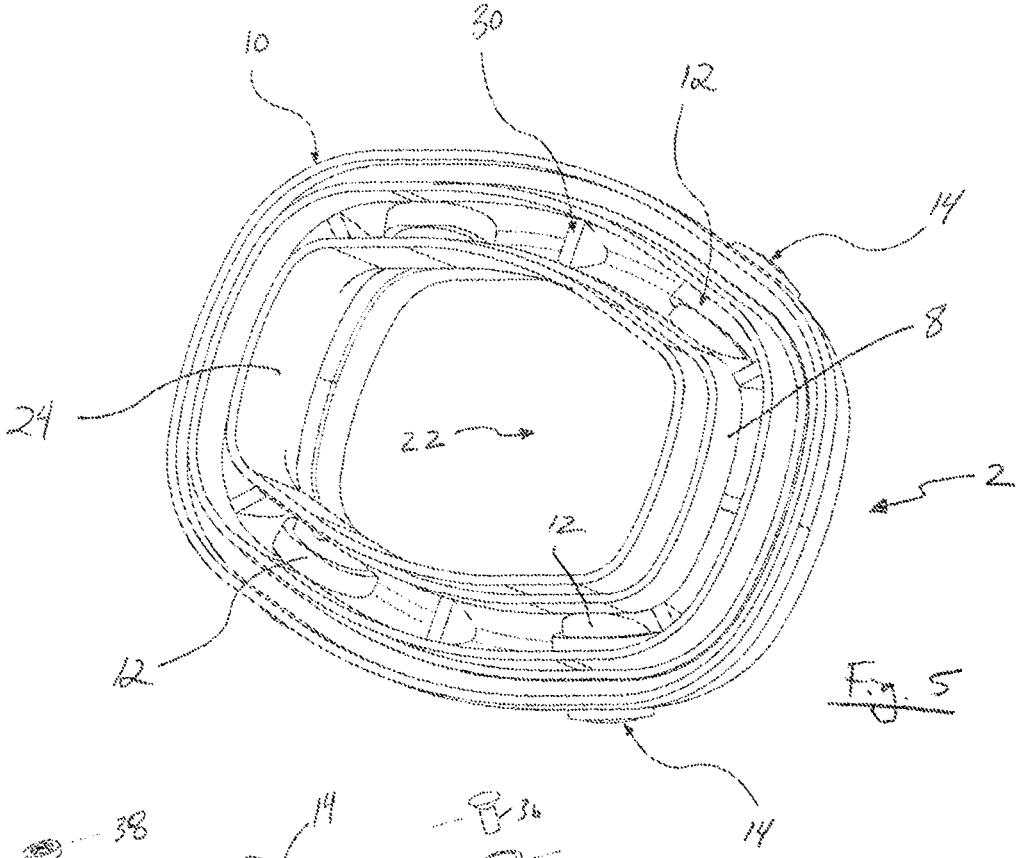

FIG. 5 is a rear perspective view of the component of FIG. 3.

Figure 6A:
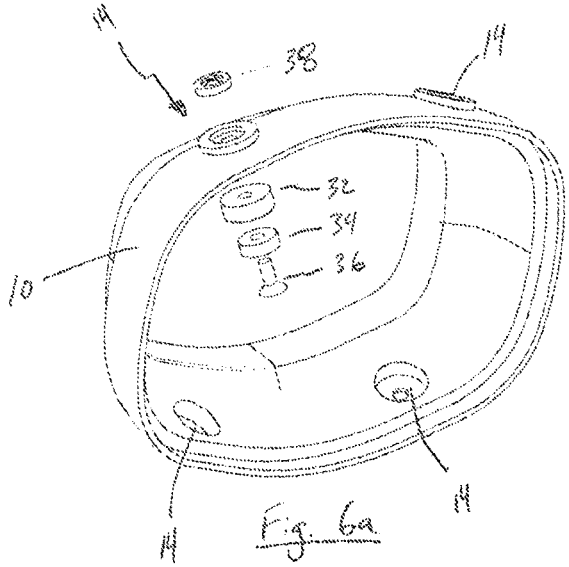

FIG. 6*a* is a rear perspective view of a component of a system for selectively connecting articles of clothing.

Figure 6B:
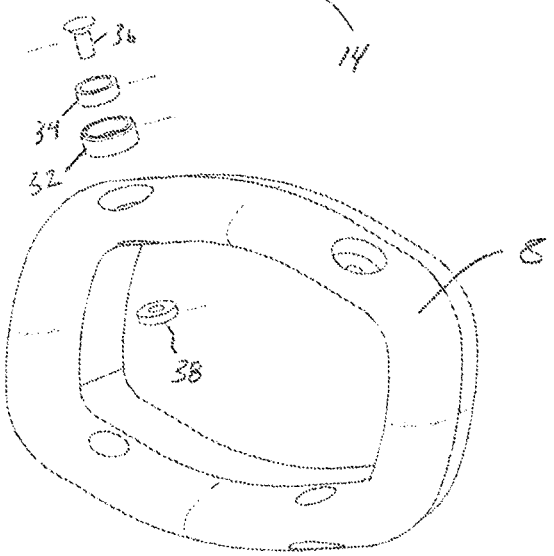

FIG. 6*b* is a front perspective view of a component of a system for selectively connecting articles of clothing.

Figure 7:
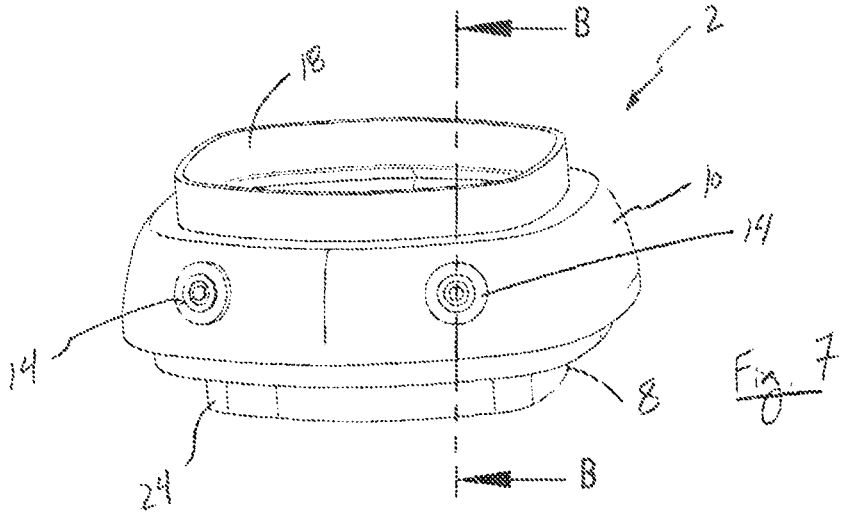

FIG. 7 is a perspective view of a component of a system for selectively connecting articles of clothing according to one embodiment of the present disclosure.

Figure 8:
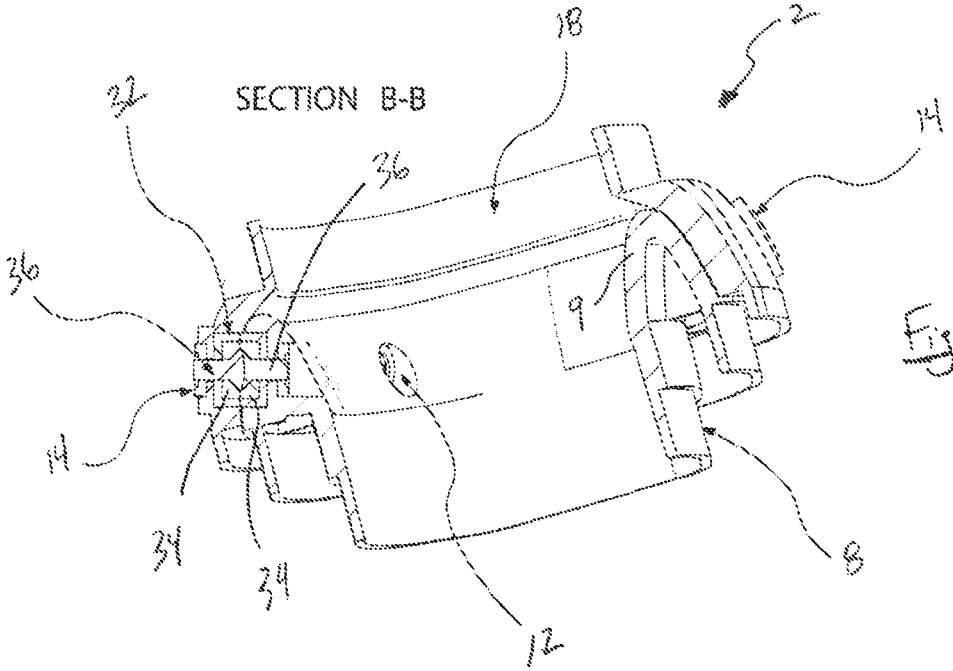

FIG. 8 is a cross-sectional view of the component of FIG. 7.

Figure 9:
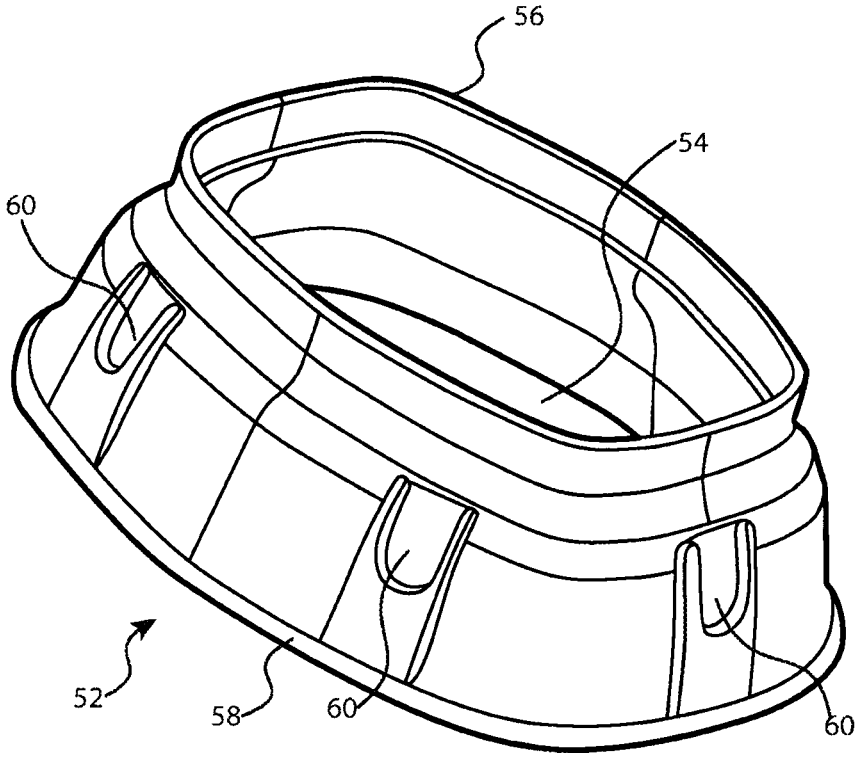

FIG. 9 is a front perspective view of a component of a system for selectively connecting articles of clothing according to one embodiment of the present disclosure.

Figure 10:
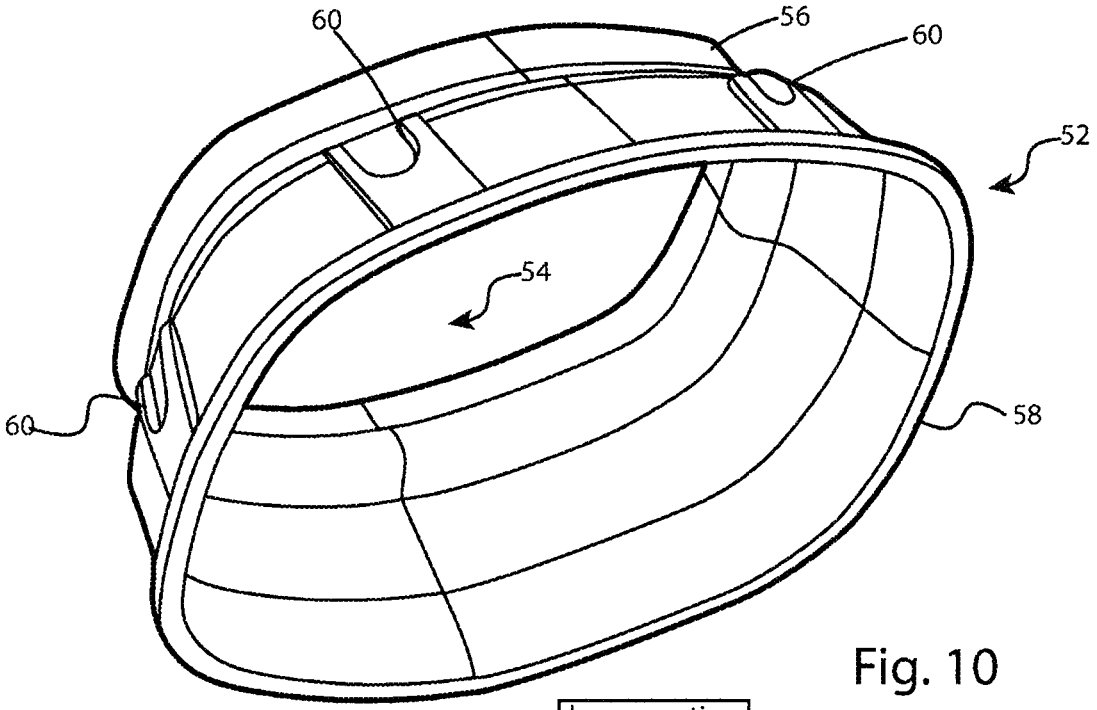

FIG. 10 is a rear perspective view of the component of FIG. 9.

Figure 11:
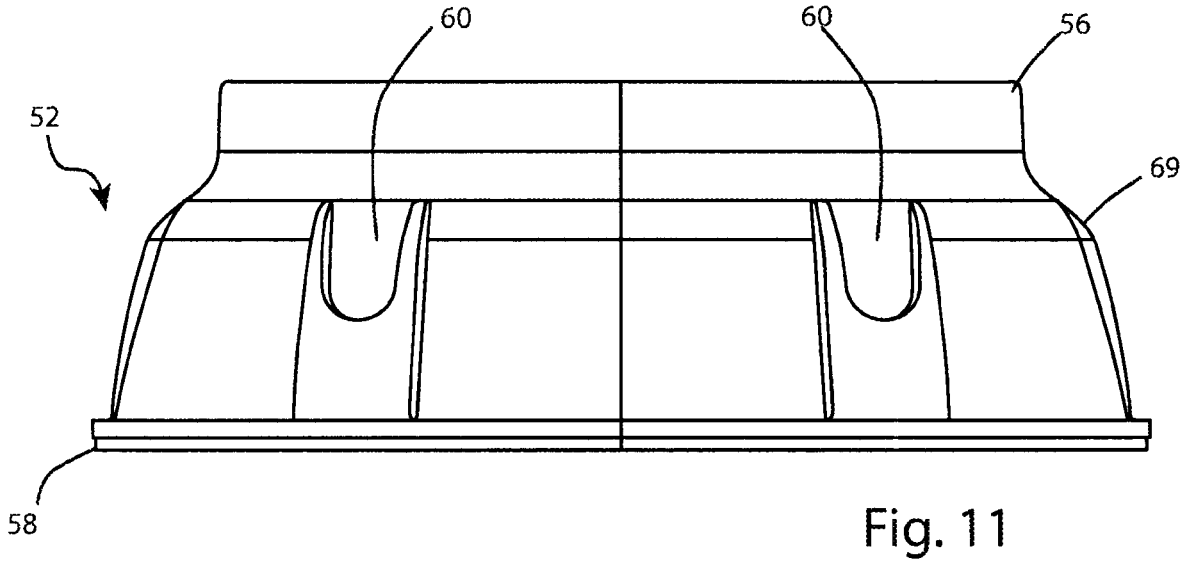

FIG. 11 is an elevation view of the component of FIG. 9.

Figure 12:
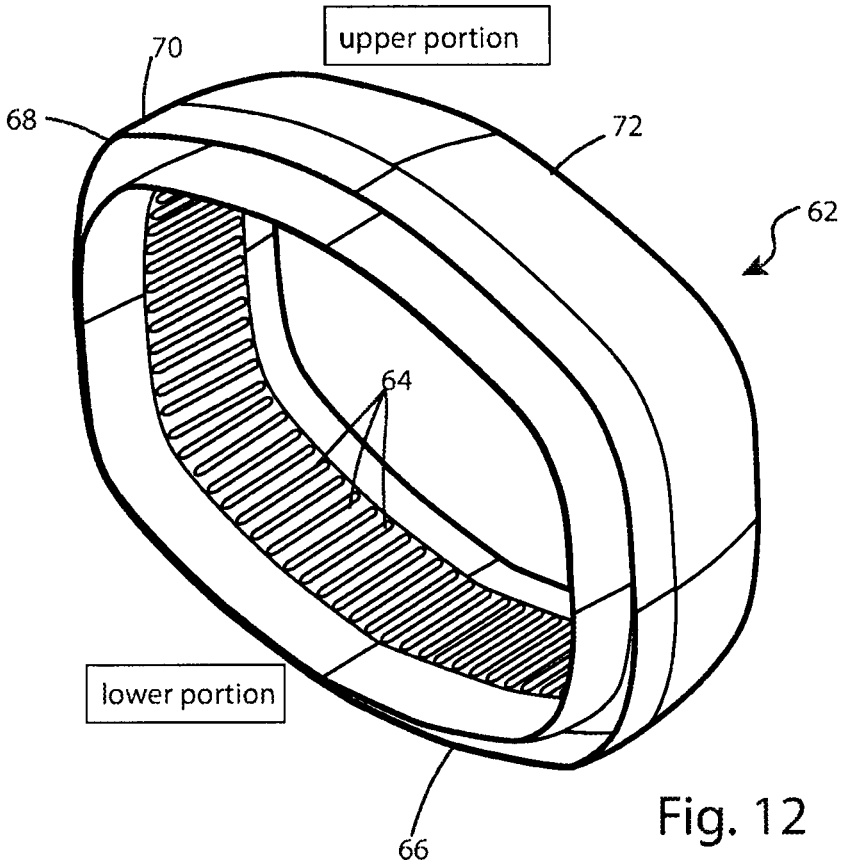

FIG. 12 is a perspective view of a component of a system for selectively connecting articles of clothing according to one embodiment of the present disclosure.

Figure 13:
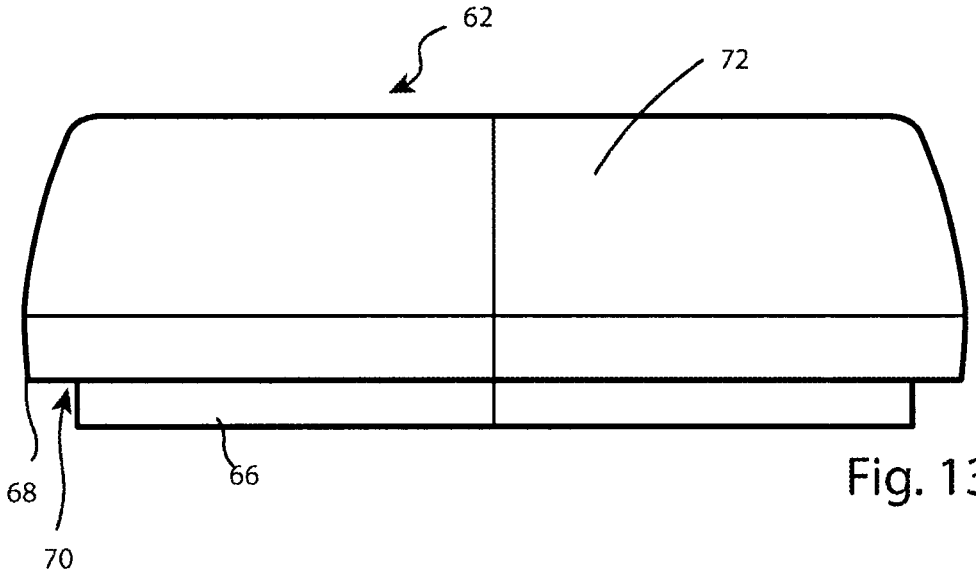

FIG. 13 is a side elevation view of the component of FIG. 12.

Figure 14:
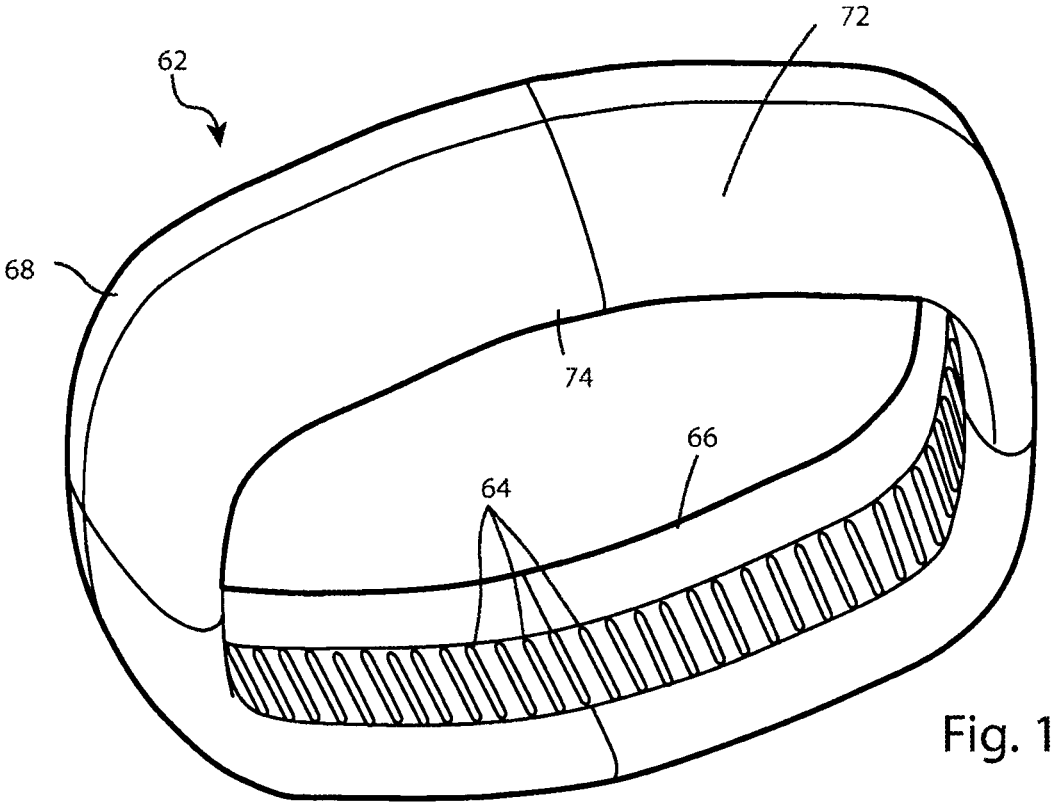

FIG. 14 is a front perspective view of the component of FIG. 12.

Figure 15:
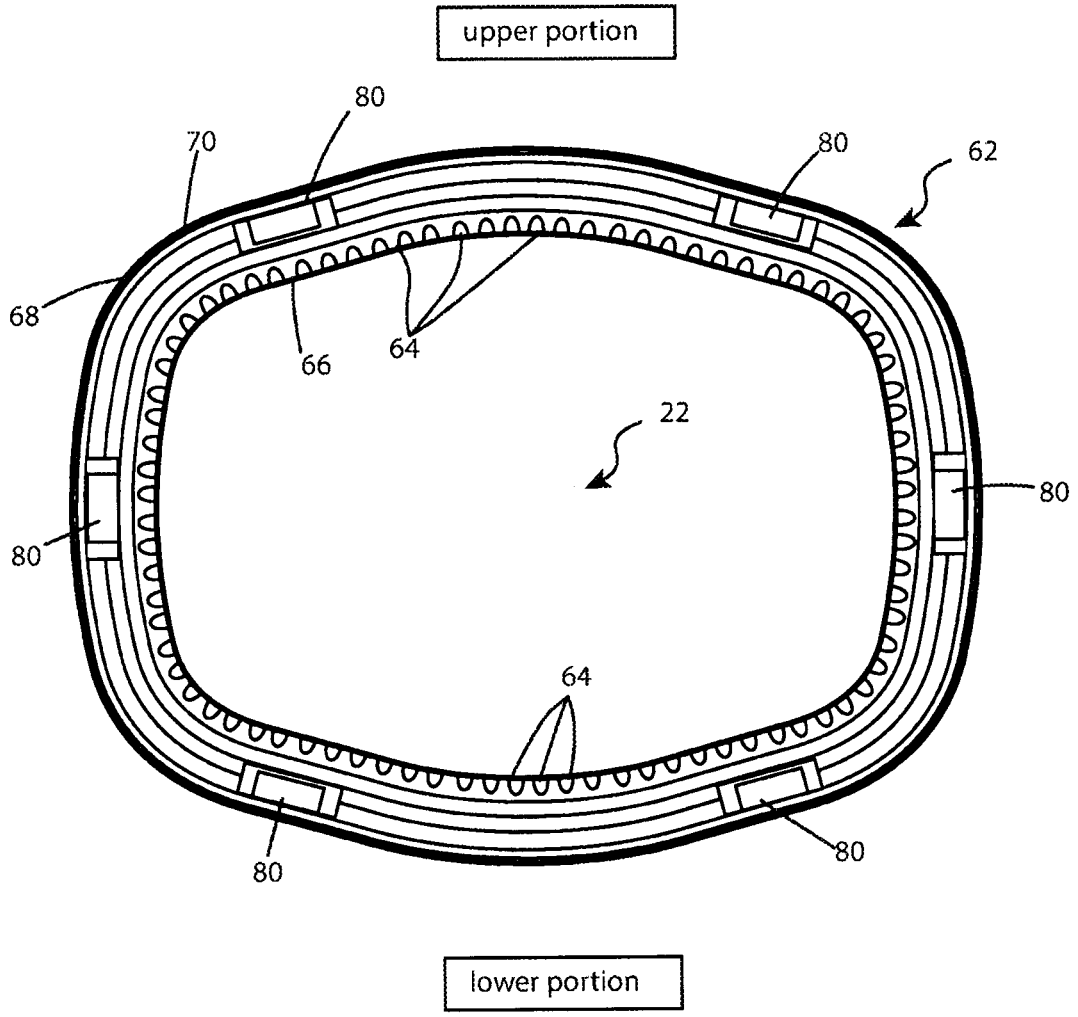

FIG. 15 is a rear elevation view of the component of FIG. 12.

Figure 16:
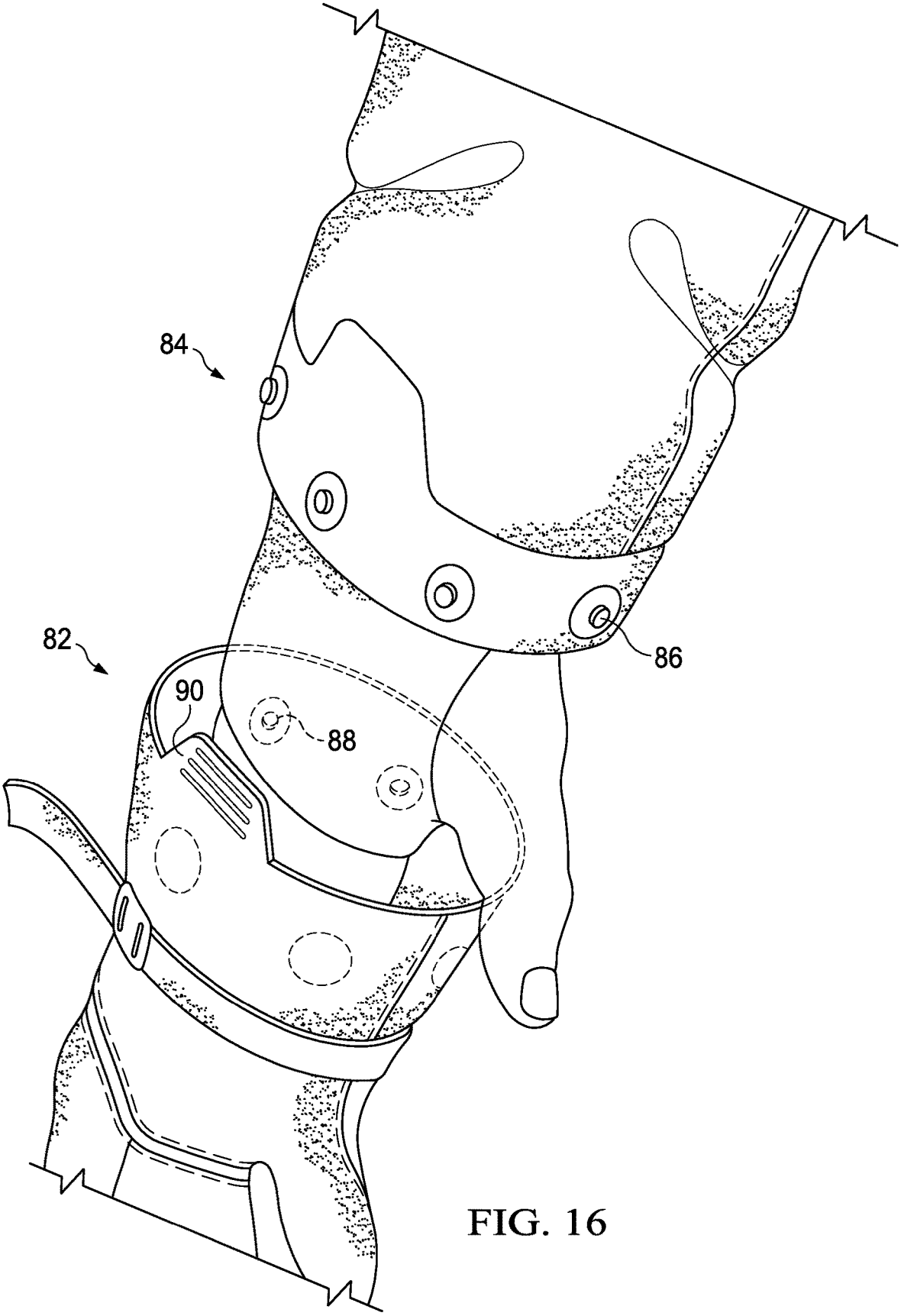

FIG. 16 is a perspective view of a system for selectively connecting articles of clothing according to one embodiment of the present disclosure.

Figure 17:
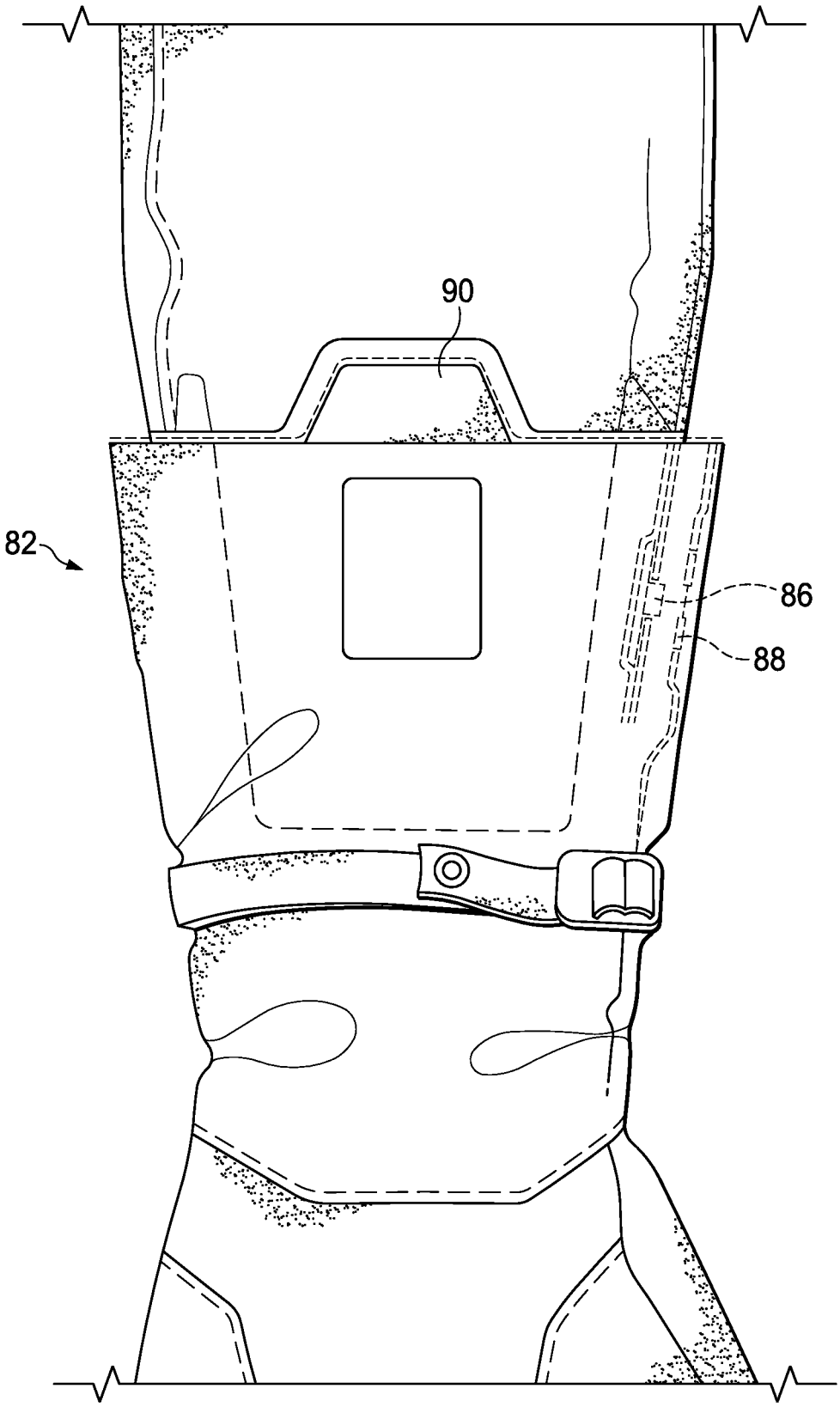

FIG. 17 is an elevation view of a system for selectively connecting articles of clothing according to one embodiment of the present disclosure.

Figure 18:
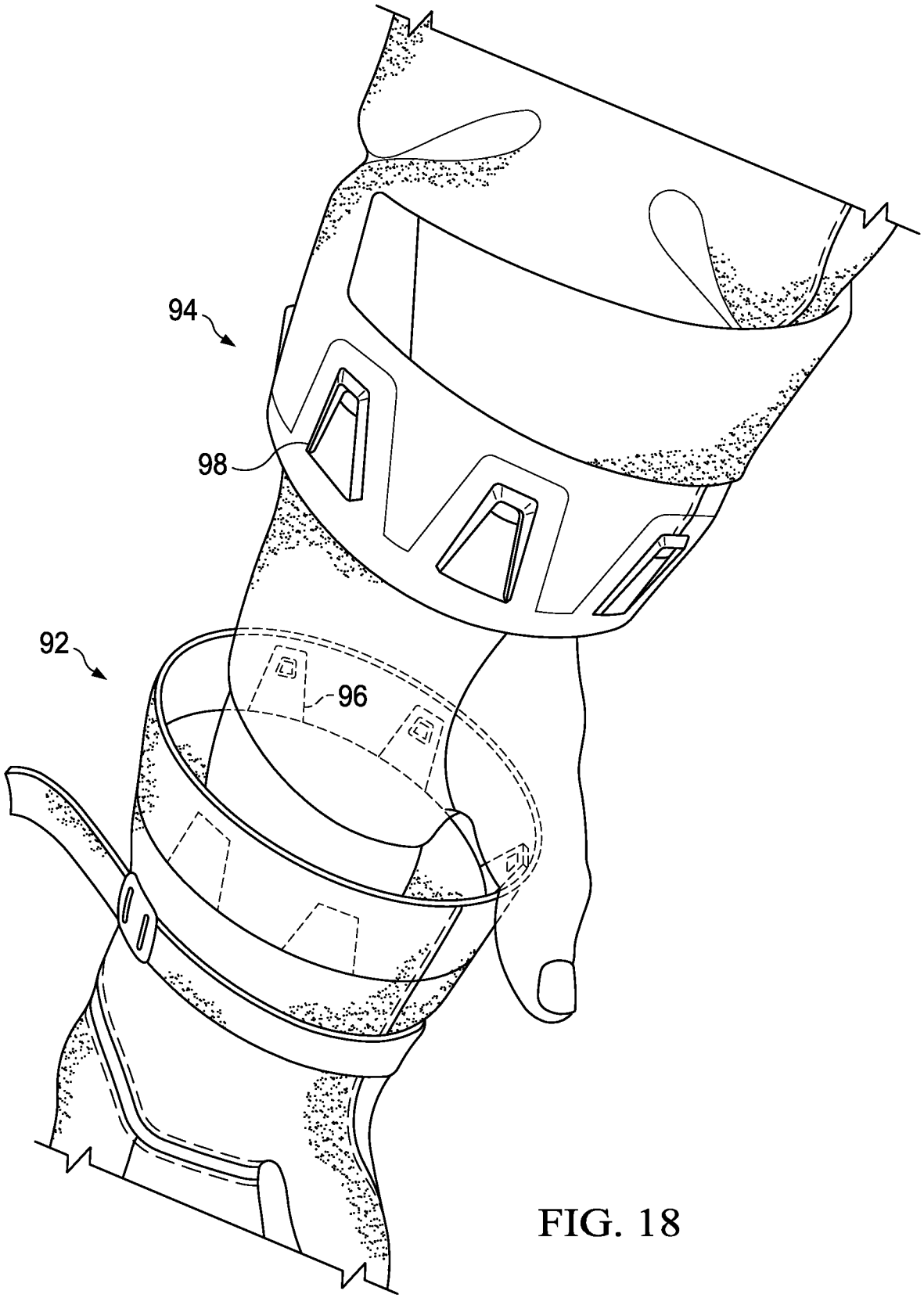

FIG. 18 is a perspective view of a system for selectively connecting articles of clothing according to one embodiment of the present disclosure.

Figure 19:
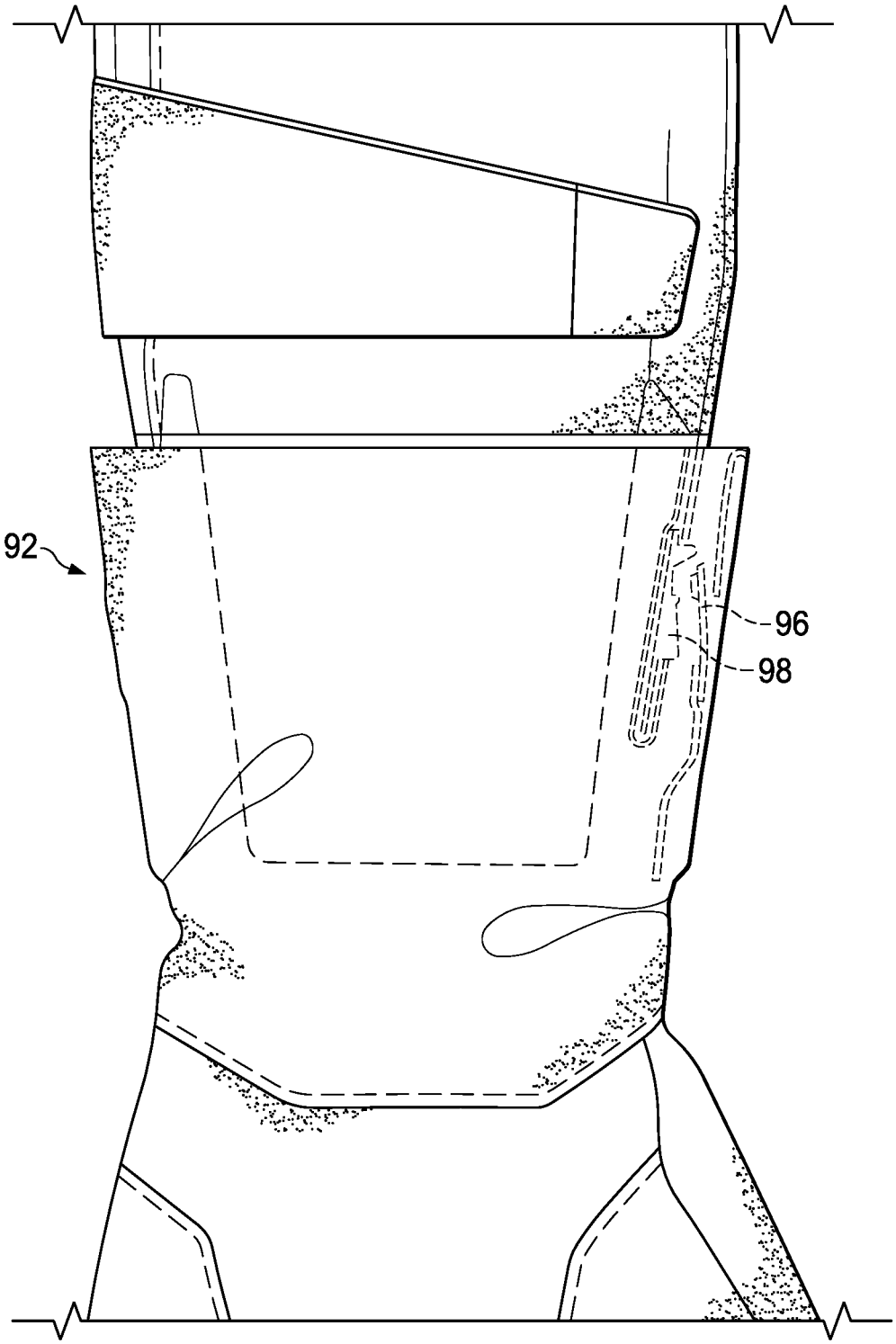

FIG. 19 is an elevation view of a system for selectively connecting articles of clothing according to one embodiment of the present disclosure.

Figure 20:
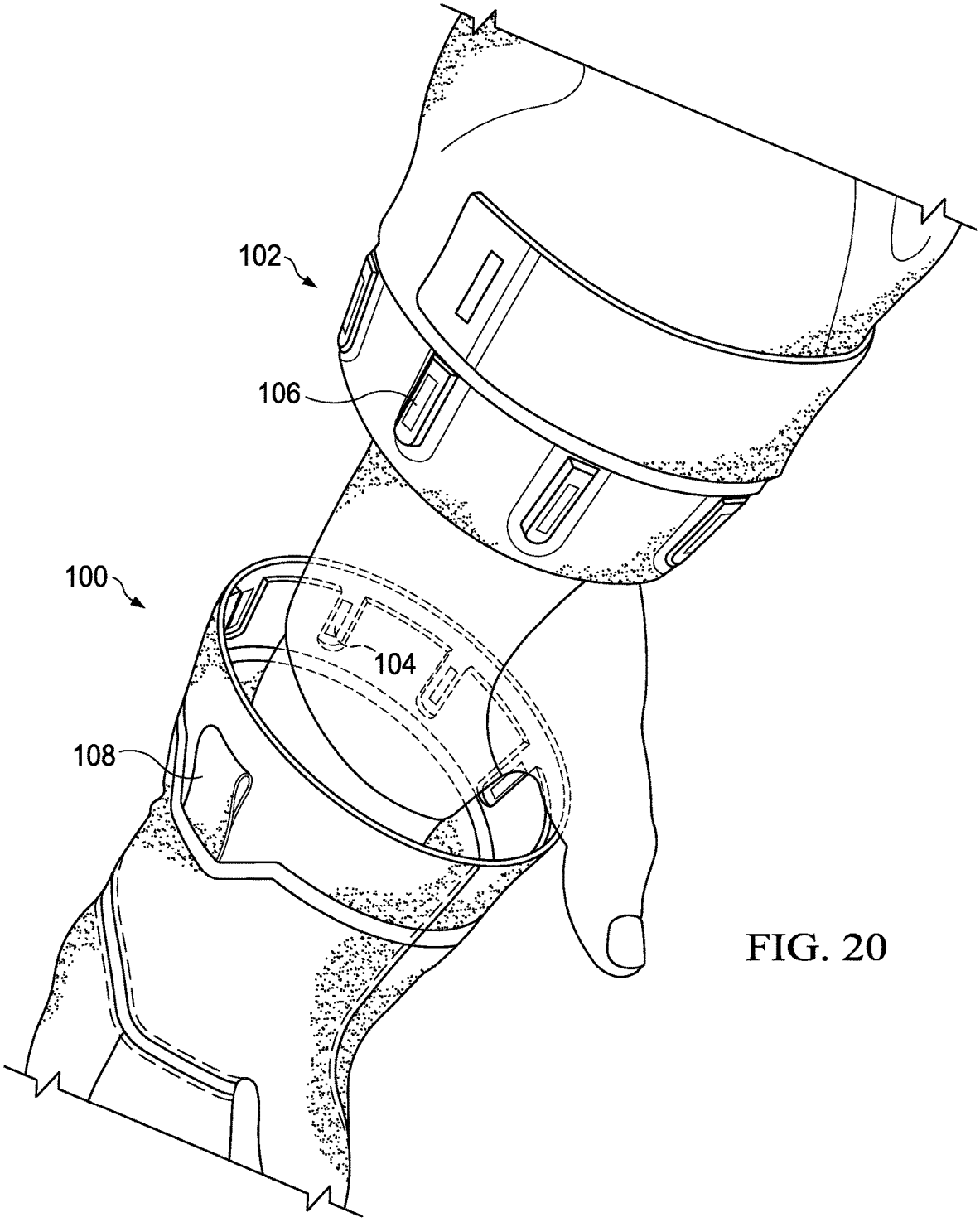

FIG. 20 is a perspective of a system for selectively connecting articles of clothing according to one embodiment of the present disclosure.

Figure 21:
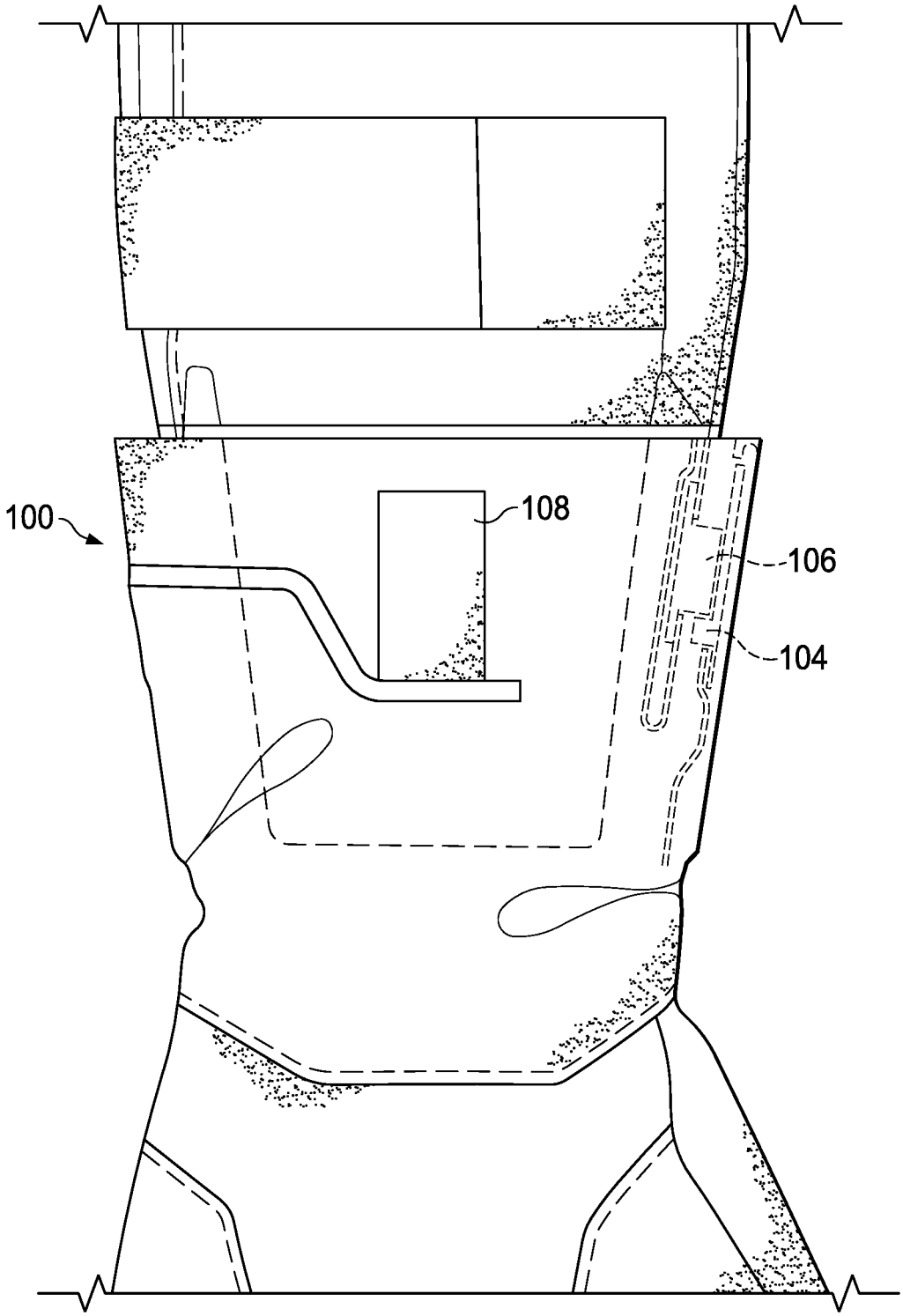

FIG. 21 is an elevation view of a system for selectively connecting articles of clothing according to one embodiment of the present disclosure.

Figure 22:
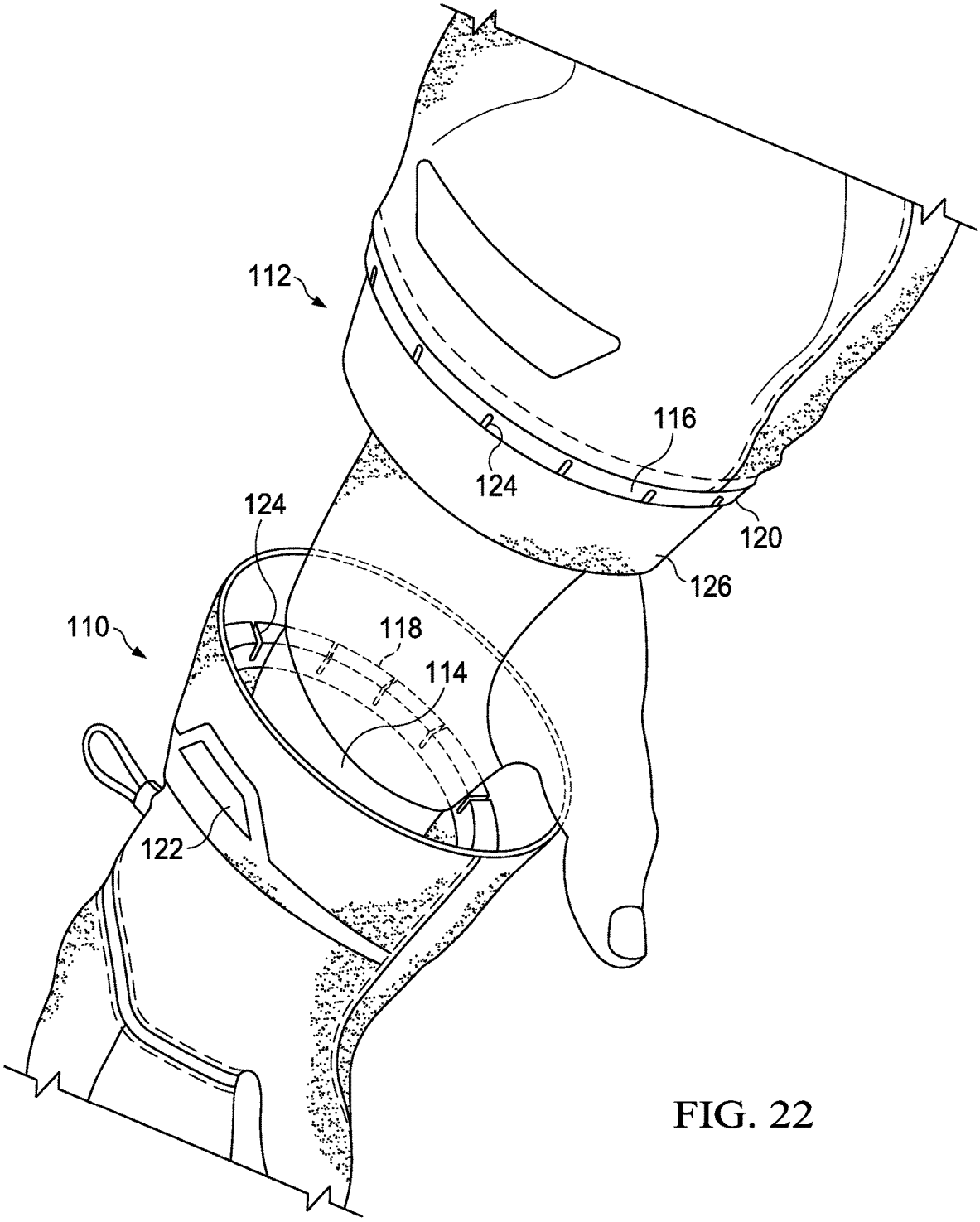

FIG. 22 is a perspective view of a system for selectively connecting articles of clothing according to one embodiment of the present disclosure.

Figure 23:
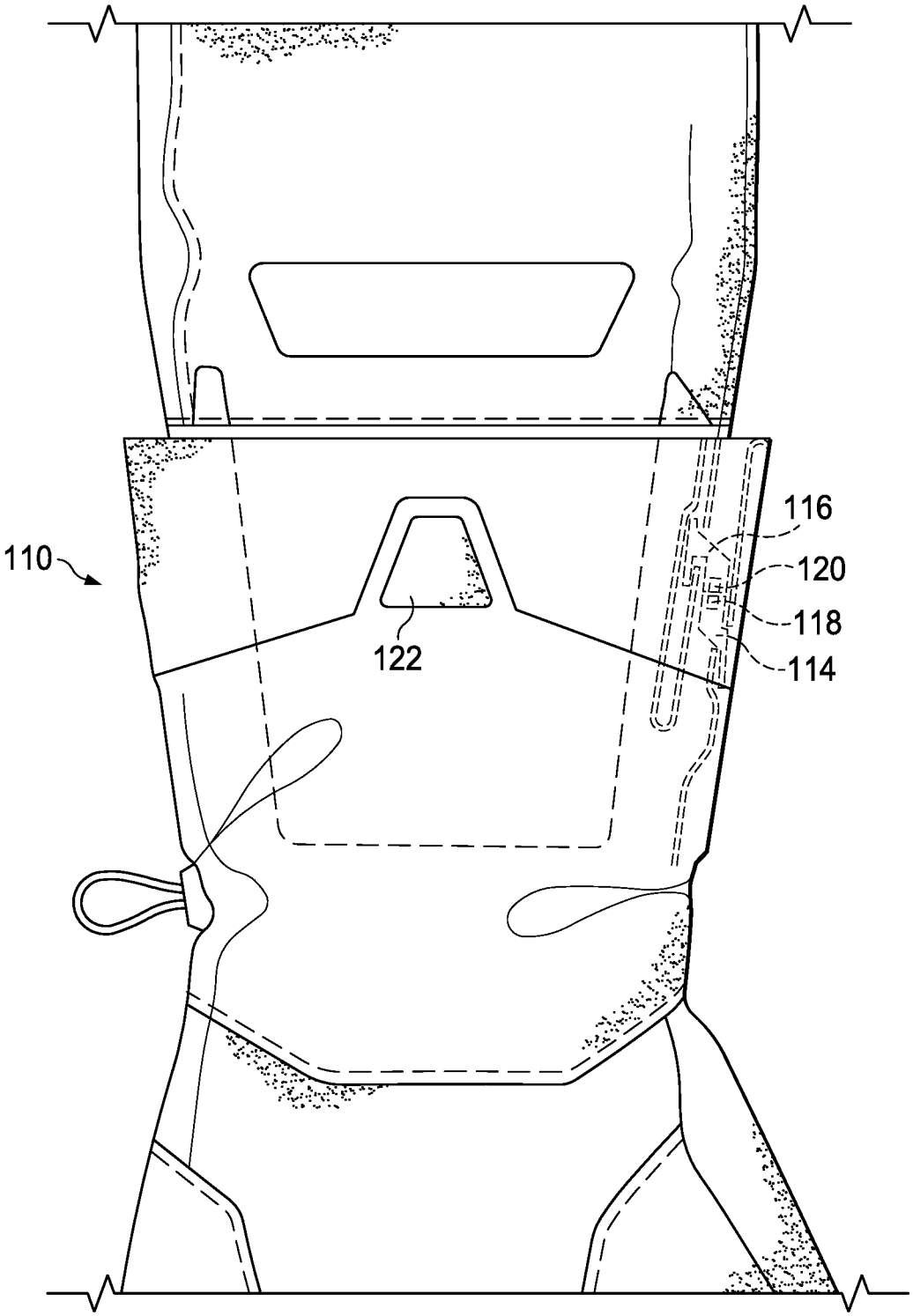

FIG. 23 is an elevation view of a system for selectively connecting articles of clothing according to one embodiment of the present disclosure.

Figure 24:
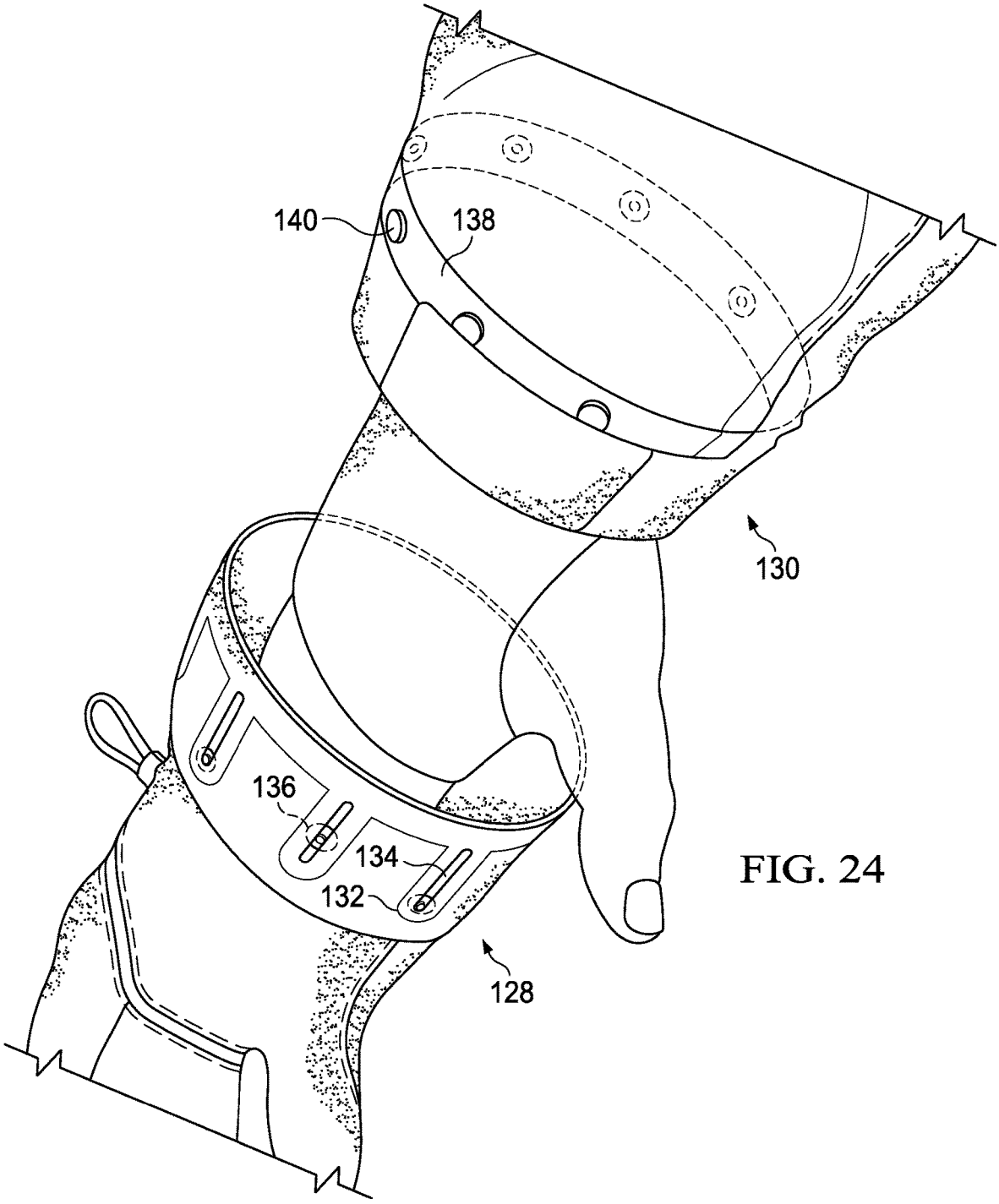

FIG. 24 is a perspective view of a system for selectively connecting articles of clothing according to one embodiment of the present disclosure.

Figure 25:
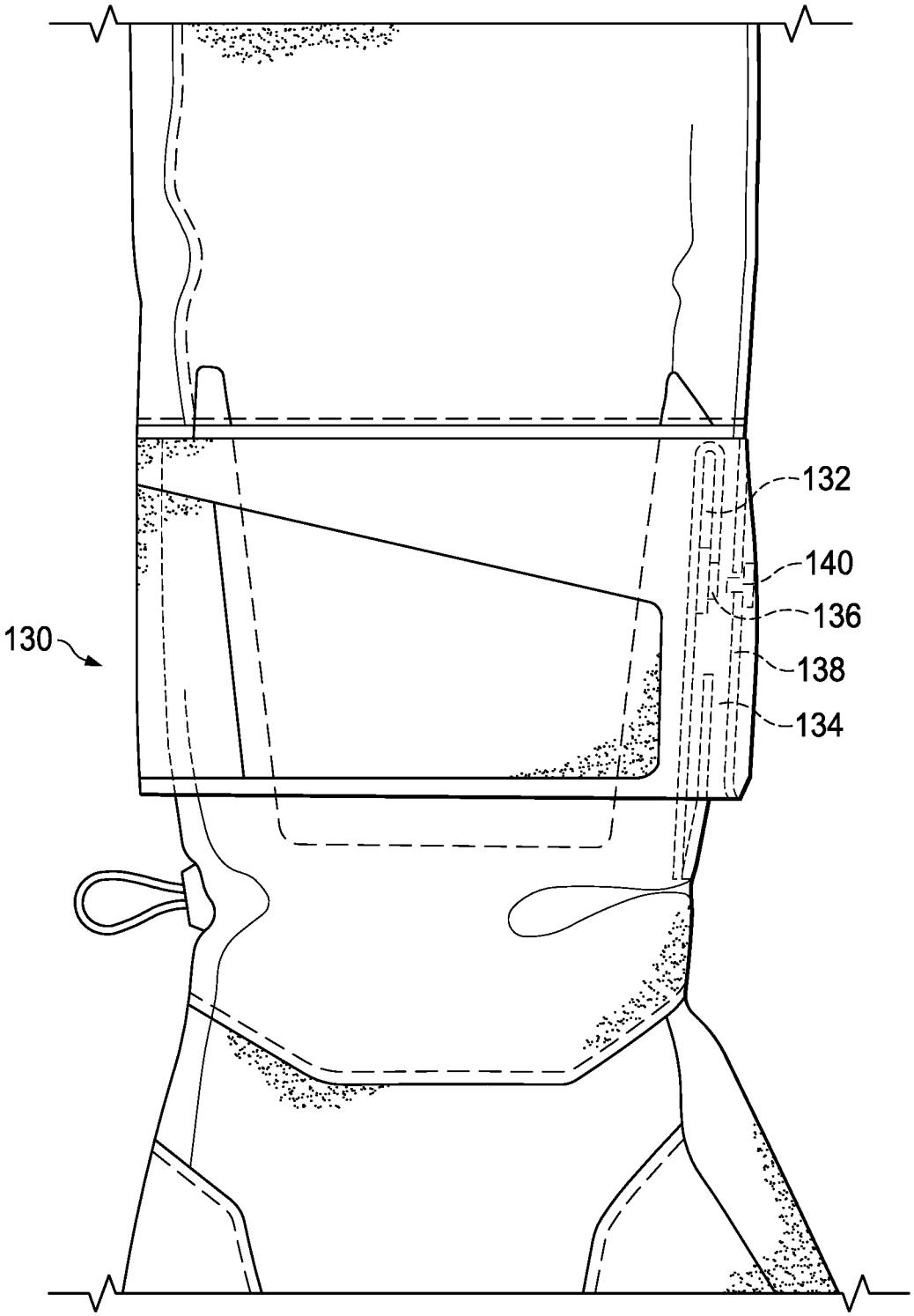

FIG. 25 is an elevation view of a system for selectively connecting articles of clothing according to one embodiment of the present disclosure.

DETAILED DESCRIPTION

The present invention has significant benefits across a broad spectrum of endeavors. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the art, can be modified in numerous ways within the scope and spirit of the invention.

In certain embodiments, and referring now to FIG. 1, a system 2 for connecting a plurality of garments 4, 6 is provided. The system preferably comprises an interface having at least one engagement device. In the embodiment of FIG. 1, the engagement device or connection comprises a first connection member 8 provided integrally with or otherwise connected to a first garment 4. In the depicted embodiment, the first garment 4 comprises a jacket or shirt having a sleeve and a cuff. The first connection member 8 comprises a cuff member with at least one connector 12 for selectively securing the first garment 4 to the second garment 6. In the depicted embodiment, the second garment 6 comprises a glove with a second connection member 10 provided proximal an opening of the glove 6. The second connection member 10 is adapted to communicate with the first connection member 8, and the second connection member 10 comprises at least one connector 14 for communication with the connector 12 of the first connection member 8. In preferred embodiments, the connectors comprise magnets that selectively connect and attached to one another, allowing for a connection between the two garments 4, 6 and thereby minimizing or eliminating cold spots or gaps between the garments, and thereby enhancing insulative properties of the system 2. In preferred embodiments, connectors 12, 14 are aligned to enable and facilitate a connection between garments such that both garments are substantially aligned along a longitudinal axis L of the garments.

In various embodiments, the connectors 12, 14 comprise annular rings or semi-annular ring portions housing rare earth magnets embedded in or proximal to an annular interface. In certain embodiments, an engagement device is provided between the first connection member 8 and the second connection member 10, wherein the first connection member comprises a conical or frustoconical shape and the second portion comprises a corresponding and opposite interface on a second article, such that at least two articles 4, 6 dock or "seat" in a preferred orientation. For example, in embodiments providing a glove-to-coat sleeve interface, an apparel dock system is provided wherein at least one of the first connection member 8 and the second connection member 10 comprises angle of between approximately 5 and 25 degrees and preferably approximately 10 degrees relative to a longitudinal axis L of glove to jacket connection. The opposing portion 8, 10 comprises a similar angled portion, wherein the two portion 8, 10 are adapted to at least partially nest or be inserted to one another opposed to forming a butt-joint as is contemplated in various alternative embodiments. In various embodiments, at least one of the first connection member 8 and the second connection member 10 comprises a single piece of material including, for example, a plastic or rubber material. In alternative embodiments, at least one of the first connection member 8 and the second connection member 10 comprises as many individual segments as required by a particular application. Specifically, the first connection member 8 or the second connection member 10 need not necessarily comprises a single ring or component extending 360 degrees around an axis L, but may comprise discrete, separate inserts within a cuff (for example).

In certain embodiments, each side of corresponding articles comprises flanges. The flanges may be sewn, glued, riveted, compression fit, heat adhered or otherwise attached to the material available on the specific apparel it is designed for (i.e. glove side of engagement device is attached to the glove material) using various known suitable connecting means and methods, as will be recognized by one of ordinary skill in the art.

In various embodiments, magnets are provided in the engagement device to selectively connect adjacent articles and help form a seal along an interface between adjacent pieces of apparel. Magnets are provided in cast, molded, or machined components, or in soft goods, or a combination of both. The interface between articles preferably comprises magnets in or on both articles, or a mixture of magnets and metal, or using hook-and-loop, snap buttons, standard clothing buttons or a combination of any of these or other device to secure the connection Embodiments of the present invention comprise magnets of any shape or size used solely or in some combination with magnetically attractive material. Magnets are embedded in or provided on the surface of an annular ring or element, to connect or seal the interface by magnetic attraction forces. Various embodiments of the present invention contemplate forming a seal between adjacent articles, such that a substantially fluid-impermeable seal is created to prevent ingress and egress of air and liquid between an interior of the combination and an external environment. However, in alternative embodiments, it is contemplated that the connection between adjacent articles need not be fluid-impermeable, but rather comprises a quick and user-friendly connection that is provided by magnets and related features as shown and described herein. It will therefore be recognized that embodiments of the present invention are not limited to devices, systems and methods wherein an air or water tight seal is created between connected articles although such embodiments are contemplated.

In a preferred embodiment, at least one connection member comprises a ring material made of a pliable plastic, silicon, thermoplastic, rubber or rubber-like material, neoprene or any material that offers shape memory and other attributes necessary for each and every application of the dock interface.

Connection members may comprise either one piece of material (3D sewn or woven, cast, extruded or otherwise manufactured), or may be built up as multi-layered component that could include a base layer, a foam or gel layer, and/or a top layer that encases the entire assembly and allows for the component to be stitched or heat adhered to the appropriate apparel location.

FIG. 1 provides one embodiment of an apparel dock system 2 comprising a first garment 4 and a second garment 6. The first garment 4 comprises a sleeve with a first connection member 8 comprising a cuff. The second garment 6 comprises a glove with a second connection member 10 provided proximal an opening of the glove. At least one of the first connection member 8 and the second connection member 10 comprises a substantially hexagonal cross-sectional shape and an angle of approximately 10 degrees to the longitudinal axis L. The preferred geometry of the components shown in FIG. 1, for example, help ensure correct seating of device(s). Connectors 12, 14 are provided comprising magnetic elements embedded in an injection molded thermoplastic material that is lightweight, pliable, provides a semi-tacky surface for sealing, has excellent shape memory and a large temperature operating range. In various embodiments, magnets are embedded in a rivet-style structure that makes manufacturing of device simple, and magnet orientation reliable.

FIG. 2 is a perspective of the embodiment provided in FIG. 1. As shown in FIG. 2, a first garment 4 and a second garment 6 are provided and adapted to be selectively interconnected. The first garment 4 comprises a sleeve of a jacket or similar item, and a first connection member 8 is attached to the first garment 4. The first connection member 8 comprises at least one connector 12 to communicate with at least one connector provided on the second garment 6. In the embodiment provided in FIGS. 1-2, the first connection member 8 is sized to be received in or nest at least partially within the second connection member 10. Specifically, the first connection member 8 comprises at least one dimension that is smaller than a dimension provided on the second connection member 10 and the first connection member 8 is adapted to be partially inserted into or be overlapped by the second connection member 10. Such "nesting" provides enhanced insulative properties, particularly when compared to a standard butt-joint connection. An interior portion of the first connection member 8 comprises a fastener 16. The fastener 16 is provided to secure the first connection member 8 to the first garment 4 and/or secure a connector 12 to the first connection member 8.

FIG. 3 is a perspective view of components of a garment dock system 2, wherein the components are shown in isolation from garments to be attached or associated with the components. Specifically, a first connection member 8 is shown as being connected to a second connection member 10. As shown, the first connection member 8 is at least partially nested within the second connection member 10. In an assembled state, the connection members 8, 10 comprise a through-hole 22. When the system 2 is provided in the form of a glove-sleeve dock as is contemplated by various embodiments of the present disclosure, the through-hole comprises an aperture for receiving a hand and/or wrist. The second connection member 10 comprises a flange 18 adapted for connection to a garment such as a glove. The flange 18 comprises an extension adapted for securing garments and textiles to the system 2. Such garments and textiles may be secured by any one or more known methods including, but not limited to, stitching, adhering, welding, etc.

FIG. 4 is a cross-sectional elevation view of the system 2 of FIG. 3, and taken about line A-A of FIG. 3. As shown in FIG. 4, the first connection member 8 is received at least partially within the second connection member 10. Specifically, a distal end 9 of the first connection member comprises a diameter or circumference that is smaller than a proximal opening of the second connection member 10, allowing at least a portion of the first connection member 8 to be inserted and mate with the second connection member. In certain embodiments a distal end 9 of the first connection member 8 comprises an arcuate surface, and the second connection member 10 comprises a corresponding arcuate surface wherein the arcuate surfaces form a mating surface. One or more magnetic members provided on the connection member 8, 10 help maintain a connection and a preferred relative positioning between the connection members 8, 10. As shown in FIG. 3, for example, the system 2 comprises a device that is not rotationally symmetrical such that the portions 8, 10 may only be mated in one of two orientations. Additionally, the provision of magnets with desired polarities is contemplated such that the connection members 8, 10 will only mate with each other in a single orientation and such that a glove may only be provided and axially oriented with respect to a sleeve in a preferred or correct arrangement, for example. Such embodiments provide a magnetic resistance if and when a glove is to be connected to a sleeve backwards, or on the wrong arm, for example. Such resistance indicates to a user that the positioning and alignment of the glove is incorrect, and the glove is only "accepted" by the sleeve when provided in the proper position and/or alignment.

Referring again to FIG. 4, a proximal end of the first connection member 8 comprises at least one of a flange 24 and a recess 26. The flange 24 and/or recess 26 provide at least one connection interface for securing a garment or textile (not shown in FIG. 4) to the connection member 8.

FIG. 5 is a rear perspective view of the system 2 as shown in FIGS. 3-4. FIG. 5 depicts the connection of first and second connection members 8, 10 in the absence of garments associated with the devices. As shown in FIG. 5, a connection between the connection members 8, 10 is established by connectors 12, 14, which are preferably magnetic members. An interior portion of the first connection member 8 comprises at least reinforcing rib 30 to provide stiffness to the device while minimizing weight.

FIG. 6*a* is a rear perspective view of a second connector 10 according to one embodiment of the present disclosure. A magnetic connector 14 is shown in an exploded state for illustrative purposes. As shown, at least one magnetic connector 14 is provided wherein a magnet 34 is secured to the second connector 10. The magnet 34 preferably comprises a rare earth magnet having an annular or disc shaped. It will be recognized, however, that the size and shape of the magnet may vary without deviating from the scope and spirit of the present invention. The magnet 34 is preferably provided within a magnet housing 32 and is secured to the second connector 10 with a rivet 36 and a rivet lock washer 38. In the depicted embodiment, the magnet 34 is secured to the connector 10 by the fasteners provided, and/or other fasteners as will be recognized by one of skill in the art.

FIG. 6*b* is a front perspective view of a first connector 8 and a magnet assembly 12 wherein certain components are provided in an exploded view. A magnetic connector 12 is shown in an exploded state for illustrative purposes. As shown, at least one magnetic connector 12 is provided wherein a magnet 34 is secured to the second connector 8. The magnet 34 preferably comprises a rare earth magnet having an annular or disc shape. It will be recognized, however, that the size and shape of the magnet may vary without deviating from the scope and spirit of the present invention. The magnet 34 is preferably provided within a magnet housing 32 and is secured to the second connector 8 with a rivet 36 and a rivet lock washer 38. In the depicted embodiment, the magnet 34 is secured to the connector 8 by the fasteners provided, and/or other fasteners as will be recognized by one of skill in the art. The magnet 34 of FIG. 6*b* preferably comprises a magnet of opposite polarity as the magnet 34 shown in FIG. 6*a*. As such, the magnets 34 of respective first connector 8 and second connector 10 are adapted to attract one another and provide a securing force between the connectors 8, 10 to selectively secure garments together (see FIG. 5, for example).

FIG. 7 is a perspective view of a first connector 8 and a second connector 10 interconnected to one another, and wherein garments are not shown as being connected for the purposes of illustration. As shown and described herein, garments such as sleeves and gloves may be secured to the flange 18 of the second connector 10 and/or the flange 24 of the first connector 8.

FIG. 8 is a cross-sectional view of the system 2 shown in FIG. 7, and taken at line B-B of FIG. 7. As shown in FIG. 8, respective magnets 34 associated with the first connector 8 and the second connector 10 are provided in communication with one another and enable a connection between the connectors 8, 10.

FIGS. 9-10 are perspective views of a connection member 52 according to one embodiment of the present disclosure. The connection member 52 is shown in isolation, and is adapted to be secured to a garment (e.g. a glove) and be selectively connectable with an additional connection member as shown and described herein. As shown in FIGS. 9-10, the connection member 52 comprises lip 58 at a proximal end, and a flange 56 extending from the distal end of the connection member 52. The connection member 52 comprises a body portion provided therebetween, which preferably comprises a tapered portion such that an opening at a proximal side of the portion 52 is larger than an opposing opening at the distal end of the connection member 52. An aperture 54 is provided to accommodate a body part of a user. A plurality of seats 60 are provided on an exterior portion of the connection member 52. The seats 60 are provided and adapted to receive magnetic devices (not shown in FIGS. 9-10) that are adapted to attract and/or communicate with additional magnetic devices. In various embodiments, the seats 60 comprise cut-outs or recesses in an exterior sidewall of the connection member 52 that are molded with the connection member or later cut-out from the same. The connection member 52, which preferably comprises a cuff or collar portion of a glove in a fully-assembled state, may be formed from any number of materials. In preferred embodiments, the connection member 52 comprises a rubber such that a durable and partially-deformable device is provided.

FIG. 11 is a side elevation view of the connection member 52 according to the embodiment of FIGS. 9-10. As shown, the connection member 52 comprises a shoulder portion 69. The shoulder portion 69 comprises an arcuate feature, wherein an interior portion of the shoulder portion 69 comprises a mating surface or contact point for a second connection member, as shown and described herein.

FIG. 12 is a rear perspective view of a second connection member 62 according to one embodiment of the present disclosure. The second connection member 62 of FIG. 12 comprises a device that is adapted to provided in communication with and/or secured to a garment, and preferably a cuff or end portion of a sleeve. The second connection member 62 is adapted to communicate with the first connection member 52 shown and described with respect to FIGS. 9-11. The second connection member 62 comprises an annular member adapted to be at least partially received within the first connection member 52. The second connection member 62 preferably comprises a first sidewall 66 and a second sidewall 72 with a gap or void 70 provided therebetween. In the depicted embodiment, the first sidewall 66 comprises an interior surface and a plurality of fins or ribs 64 extending substantially parallel to a longitudinal axis. The ribs 64 are provided to enhance the rigidity and structural integrity of the connection member 62, while reducing weight. Additionally, the ribs 64 provide an additional benefit of reducing a contact area with a user's skin and promoting air flow along the user's skin and/or through the device 62.

FIG. 13 is a side elevation view of the second connection member of the embodiment of FIG. 12. As shown, the second connection member 62 comprises a first sidewall 66 and a second sidewall 72 with a void 70 provided therebetween. The second sidewall 72 comprises a lip 68 at a proximal end thereof. The void 70 may house or contain reinforcing ribs and/or magnetic devices for selectively connecting the second connection member 62 with the first connection member 52.

FIG. 14 is a perspective view of the connection member 62 according to the embodiment of FIG. 13. As shown in FIG. 14, for example, a distal end 74 of the connection member 62 comprises a convex or bullet shaped feature that is adapted to be received within the first connection member. The second connection member 62 is preferably matingly received within the first connection member and selectively secured by at least two corresponding magnetic elements.

FIG. 15 is a rear elevation view of the second connection member 62 according to FIG. 14. As shown, the second connection member comprises at least one chamber 80 for receiving a magnetic element. In preferred embodiments, a plurality of chambers 80 are provided and distributed around a circumference of the second connection member 62. The chambers 80 comprise sidewalls for receiving at least one magnet and confining the magnet in preferred location and/or position such that the magnet is not allowed to migrate in the void 70 that extends around the circumference of the member 62. Preferably, the chamber(s) 80 are provided such that they correspond with or are aligned with seats 60 provided on the first connection member and such that magnetic elements may be aligned to enable connection between the connection members 52, 62. The chambers 80 may receive one or more magnetic elements in a press-fit manner, or the magnets may be covered or sealed within the chambers 80 after placement therein.

FIG. 16 is a perspective view of a system for selectively connecting articles of clothing according to one embodiment of the present disclosure. FIG. 17 is an elevation view of a system for selectively connecting articles of clothing according to the embodiment of FIG. 16. As shown in FIGS. 16-17, the connection member 82 is attached to a glove and comprises a plurality of female magnet locators 88 spaced circumferentially around the inside of the glove opening. The connection member 82 further comprises an integrated pull tab 90. The connection member 84 is attached to a garment cuff and comprises a plurality of male magnet locators 86 spaced circumferentially around the outside of the garment cuff. Connection member 84 is sized to nest within connection member 82. When nested, the female magnet locators 88 are adapted to receive the corresponding male magnet locators 86. The magnets in the male locators are oriented to either attract or repel the magnet in the corresponding position on the female locators in order to allow the glove and garment cuff to engage in only one orientation. Alternatively, or in combination with the orientation configuration, one or more magnets may be replaced with a magnetically attractive material such as steel.

FIG. 18 is a perspective view of a system for selectively connecting articles of clothing according to one embodiment of the present disclosure. FIG. 19 is an elevation view of a system for selectively connecting articles of clothing according to the embodiment of FIG. 18. As shown in FIGS. 18-19, the connection member 92 is attached to a glove and comprises a plurality of molded tab locators 96 spaced circumferentially around the inside of the glove opening. Molded tab locators 96 each include an embedded magnet. The connection member 94 is attached to a garment cuff and comprises a plurality of receiver garage locators 98 spaced circumferentially around the outside of the garment cuff. Receiver garage locators 98 each include an embedded magnet. Connection member 94 is sized to nest within connection member 92. When nested, the receiver garage locators 98 are adapted to receive the corresponding molded tab locators 96. The magnets in the molded tab locators are oriented to either attract or repel the magnet in the corresponding position on the receiver garage locators in order to allow the glove and garment cuff to engage in only one orientation. Alternatively, or in combination with the orientation configuration, one or more magnets may be replaced with a magnetically attractive material such as steel.

FIG. 20 is a perspective view of a system for selectively connecting articles of clothing according to one embodiment of the present disclosure. FIG. 21 is an elevation view of a system for selectively connecting articles of clothing according to the embodiment of FIG. 20. As shown in FIGS. 20-21, the connection member 100 is attached to a glove and comprises a plurality of molded garage locators 104 spaced circumferentially around the inside of the glove opening. Molded garage locators 104 each include a magnet array. The connection member 102 is attached to a garment cuff and comprises a plurality of molded tab locators 106 spaced circumferentially around the outside of the garment cuff. Molded tab locators 106 each include an embedded magnet. Connection member 102 is sized to nest within connection member 100. When nested, the molded garage locators 104 are adapted to receive the corresponding molded tab locators 106. The magnets in the molded garage locators are oriented to either attract or repel the magnet in the corresponding position on the molded tab locators in order to allow the glove and garment cuff to engage in only one orientation. Alternatively, or in combination with the orientation configuration, one or more magnets may be replaced with a magnetically attractive material such as steel.

FIG. 22 is a perspective view of a system for selectively connecting articles of clothing according to one embodiment of the present disclosure. FIG. 23 is an elevation view of a system for selectively connecting articles of clothing according to the embodiment of FIG. 22. As shown in FIGS. 22-23, the connection member 110 is attached to a glove and comprises a molded bracelet 114 with a plurality of magnet locators 118 spaced circumferentially around the edge of the bracelet 114. Bracelet 114 also comprises a plurality of notches 124 to enhance breathability of the system and allow for flexible movement of the bracelet. Connection member 112 is attached to a garment cuff and comprises a molded bracelet 116 with a plurality of magnet locators 120 spaced circumferentially around the edge of the bracelet 116. Bracelet 116 also comprises a plurality of notches 124 to enhance breathability of the system and allow for flexible movement of the bracelet. Connection member 112 also comprises a knitted cuff 126. Connection member 112 is sized to nest within connection member 110. When nested, the edges of bracelet 114 and bracelet 116 are brought together so that the corresponding magnet locators 118 and 120 pull the bracelets together. With the edges of the bracelets joined, the notches 124 of the bracelets are aligned to enhance breathability of the system. The magnets in the bracelet 114 are oriented to either attract or repel the magnet in the corresponding position in the bracelet 116 in order to allow the glove and garment cuff to engage in only one orientation. The magnets in bracelet 114 and 116 are orient such that their poles are substantially perpendicular to the circumference of the bracelets. Alternatively, or in combination with the orientation configuration, one or more magnets may be replaced with a magnetically attractive material such as steel.

FIG. 24 is a perspective view of a system for selectively connecting articles of clothing according to one embodiment of the present disclosure. FIG. 25 is an elevation view of a system for selectively connecting articles of clothing according to the embodiment of FIG. 24. As shown in FIGS. 24-25, the connection member 128 is attached to a glove and comprises a plurality of magnet interfaces 132 spaced circumferentially around the around the glove opening. Each magnet interface 132 comprises a slot 134 and a sliding magnet 136 within the slot. Connection member 130 is attached to a garment cuff and comprises a bracelet 138 with a plurality of magnet locators 140 spaced circumferentially around the bracelet 138. Connection member 128 is sized to nest within connection member 130. When nested, the magnet locators 140 of bracelet 138 are brought together with the corresponding sliding magnets 136 of magnet interfaces 132 to pull the connection interfaces together. Sliding magnet 136 may slide within the slot 134 to allow for fit of the interface. The magnets in the bracelet 138 are oriented to either attract or repel the magnet in the corresponding position in the magnet interfaces 132 in order to allow the glove and garment cuff to engage in only one orientation. Alternatively, or in combination with the orientation configuration, one or more magnets may be replaced with a magnetically attractive material such as steel.

While various features are described herein with respect to one or more embodiments, it will be expressly understood that such features are not limited or exclusive to a particular embodiment. For example, the magnet connecting features of FIGS. **6*a*-6*b* may be provided with any one or more embodiments shown and described herein. Additionally, the ribs (FIG. 12, item 64, for example) are not exclusive to the embodiment of FIG. 12** and may be included with various embodiments shown and described herein. It will be recognized that the drawings and related discussions herein are for illustrative purposes, and no limitation is provided herewith with respect to combining and/or substituting various components and features discussed herein between different embodiments.

Various features and embodiments of trailer devices have been provided herein. It will be recognized, however, that various features are not necessarily specific to certain embodiments and may be provided on any one or more embodiments. For example, various hot water pressure washing features may be provided on a trailer with any one or more braking mechanisms as shown and described herein. The present disclosure and embodiments provided herein are not mutually exclusive and may be combined, substituted, and omitted. The scope of the invention(s) provided herein is thus not limited to any particular embodiment, drawing, or particular arrangement of features.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A system for selectively connecting a glove to an article of clothing, the system comprising:

a glove having a first end and a second end;

the second end of the glove comprising a first connection member, wherein the first connection member comprises a first locator portion adapted to receive a first tab portion of a second connection member attached to an article of clothing, the first tab portion comprising at least one associated magnet, and the first locator portion comprising at least one associated magnet;

wherein the at least one magnet of the first locator portion of the first connection member is adapted to be attracted to the at least one magnet of the first tab portion of the second connection member to selectively connect the first and second connection members;

wherein the first connection member comprises a second locator portion adapted to receive a second tab portion of the second connection member, the second tab portion comprising at least one associated magnet, and the second locator portion comprising at least one associated magnet; and wherein the at least one magnet of the second locator portion of the first connection member is adapted to be attracted to the at least one magnet of the second tab portion of the second connection member to selectively connect the first and second connection members.

2. The system of claim 1, wherein the article of clothing comprises a sleeve of a jacket.

3. The system of claim 1, wherein the magnetic attraction between the magnets is operable to maintain the glove in communication with the second connection member until a user applies a removal force to at least one of the glove and the article of clothing.

4. The system of claim 1, wherein the first connection member comprises a rubber.

5. The system of claim 1, wherein the first connection member comprises a foam.

6. The system of claim 1, wherein an overlap between the connectors is operable to provide thermal insulation to a user wearing the glove and article of clothing.

7. The system of claim 1, wherein the first connection member is secured to the glove by at least one of gluing, stitching, and welding.

8. The system of claim 1, wherein the first connection member comprises a third locator portion adapted to receive a third tab portion of the second connection member, the third tab portion comprising at least one associated magnet, and the third receiver portion comprising at least one associated magnet; and wherein the at least one magnet of the third locator portion of the first connection member is adapted to be attracted to the at least one magnet of the third tab portion of the second connection member.

9. The system of claim 8, wherein the first connection member comprises a fourth locator portion adapted to receive a fourth tab portion of the second connection member, the fourth tab portion comprising at least one associated magnet, and the fourth receiver portion comprising at least one associated magnet; and wherein the at least one magnet of the fourth locator portion of the first connection member is adapted to be attracted to the at least one magnet of the fourth tab portion of the second connection member.

10. A system for selectively connecting articles of clothing, the system comprising:

a glove having a first end and a second end;

a sleeve having a first end and a second end;

the second end of the glove comprising a first connection member, and the first end of the sleeve comprising a second connection member;

wherein the first connection member comprises a first locator portion, the first locator portion comprising at least one associated magnet;

wherein the second connection member comprises a first tab portion, the first tab portion comprising at least one associated magnet;

wherein the first tab portion is sized to be at least partially received within the first locator portion to selectively connect the glove and the sleeve; and wherein a magnetic attraction between the magnets is operable to maintain the glove in communication with the sleeve until a user applies a removal force to at least one of the glove and the sleeve.

11. The system of claim 10, wherein at least one of the first connection member and the second connection member comprises one of a rubber, foam, or fabric.

12. The system of claim 10, wherein the second connection member is received at least partially within the first connection member, and wherein an overlap between the connectors is operable to provide thermal insulation to a user wearing the glove and sleeve.

13. The system of claim 10, wherein the first connection member is secured to the glove by at least one of gluing, stitching, and welding.

14. The system of claim 10, wherein the second connection member is secured to the sleeve by at least one of gluing, stitching, and welding.

15. The system of claim 10, wherein the first connection member comprises a second locator portion, the second locator portion comprising at least one associated magnet; wherein the second connection member comprises a second tab portion, the second tab portion comprising at least one associated magnet; and wherein the second tab portion is sized to be at least partially received within the second locator portion to selectively connect the glove and the sleeve.

16. The system of claim 15, wherein the first connection member comprises a third locator portion, the third locator portion comprising at least one associated magnet; wherein the second connection member comprises a third tab portion, the third tab portion comprising at least one associated magnet; and wherein the third tab portion is sized to be at least partially received within the third locator portion to selectively connect the glove and the sleeve.

17. The system of claim 16, wherein the first connection member comprises a fourth locator portion, the fourth locator portion comprising at least one associated magnet; wherein the second connection member comprises a fourth tab portion, the fourth tab portion comprising at least one associated magnet; and wherein the fourth tab portion is sized to be at least partially received within the fourth locator portion to selectively connect the glove and the sleeve.

* * * * *